US007657196B2

(12) United States Patent
Yamaguchi et al.

(10) Patent No.: US 7,657,196 B2
(45) Date of Patent: Feb. 2, 2010

(54) COMPACT IMAGE FORMING APPARATUS WITH A MOVEABLE OPTICAL SENSOR

(75) Inventors: Toshitaka Yamaguchi, Kanagawa (JP); Masaharu Furuya, Kanagawa (JP); Takahiro Nakayama, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 48 days.

(21) Appl. No.: 12/021,049

(22) Filed: Jan. 28, 2008

(65) Prior Publication Data

US 2008/0187343 A1 Aug. 7, 2008

(30) Foreign Application Priority Data

Feb. 2, 2007 (JP) ..... 2007-023880
Nov. 22, 2007 (JP) ..... 2007-303168

(51) Int. Cl.
*G03G 15/00* (2006.01)

(52) U.S. Cl. ..... 399/49

(58) Field of Classification Search ..... 399/49, 399/74, 302, 308
See application file for complete search history.

(56) References Cited

U.S. PATENT DOCUMENTS 5,418,603 A * 5/1995 Kusumoto et al. ..... 399/16
5,678,125 A 10/1997 Kutsuwada et al.
5,697,020 A 12/1997 Sato et al.
5,815,767 A 9/1998 Kutsuwada et al.
5,819,136 A 10/1998 Tomita et al.
5,887,224 A 3/1999 Mizuishi et al.
5,915,143 A 6/1999 Watanabe et al.
5,923,935 A 7/1999 Yamaguchi
6,006,050 A 12/1999 Watanabe et al.
6,006,051 A 12/1999 Tomita et al.
6,055,388 A 4/2000 Watanabe et al.
6,144,822 A 11/2000 Yamaguchi et al.
6,148,161 A 11/2000 Usui et al.
6,266,501 B1 7/2001 Mizuishi et al.
6,389,255 B1 5/2002 Sawada et al.
6,807,386 B2 10/2004 Yasui et al.
7,221,887 B2 5/2007 Kimura et al.
7,277,667 B2 10/2007 Saito et al.
2005/0078991 A1 4/2005 Kimura et al.
2007/0059071 A1 3/2007 Shinshi et al.
2007/0110464 A1 5/2007 Nakayama et al.

FOREIGN PATENT DOCUMENTS

JP 2001-34030 2/2001

(Continued)

*Primary Examiner*—Quana M Grainger
(74) *Attorney, Agent, or Firm*—Oblon, Spivak, McClelland, Maier & Neustadt, L.L.P.

(57) ABSTRACT

An optical sensor detects at least one of a toner image and a toner adhesion amount per unit area based on a change of an optical characteristic on a surface of an endless belt member. A control unit performs a predetermined process based on a detection result obtained by the optical sensor. A sensor moving unit moves the optical sensor between a first position in opposite to a belt supporting area in which the endless belt member is supported by a supporting roller and a second position that is different from the first position. The detection result is obtained by the optical sensor when the optical sensor is placed at the first position by the sensor moving unit.

20 Claims, 13 Drawing Sheets

FOREIGN PATENT DOCUMENTS

| | | | | |
|---|---|---|---|---|
| JP | 2002-6568 | | | 1/2002 |
| JP | 2002287438 | A | * | 10/2002 |
| JP | 3473346 | | | 9/2003 |
| JP | 2004-272288 | | | 9/2004 |
| JP | 2005-210469 | | | 8/2005 |
| JP | 2005-258379 | | | 9/2005 |
| JP | 2005284005 | A | * | 10/2005 |
| JP | 2006-47934 | | | 2/2006 |

* cited by examiner

COMPACT IMAGE FORMING APPARATUS WITH A MOVEABLE OPTICAL SENSOR

CROSS-REFERENCE TO RELATED APPLICATIONS

The present application claims priority to and incorporates by reference the entire contents of Japanese priority documents 2007-023880 filed in Japan on Feb. 2, 2007 and 2007-303168 filed in Japan on Nov. 22, 2007.

BACKGROUND OF THE INVENTION

1. Field of the Invention

The present invention relates to a technology for detecting a toner image transferred onto an endless belt member and detecting toner adhesion amount per unit area in the toner image.

2. Description of the Related Art

In general, an image forming apparatus such as a copier and a printer disclosed in Japanese Patent Application Laid-open No. 2002-006568 and Patent Application Laid-open No. 2001-034030 has been known, in which an electrostatic latent image is formed on an image carrier such as a photosensitive element by optically scanning the image carrier, and a toner image is formed by developing the latent image with toner. In the above type of image forming apparatus, if a setting of image forming conditions such as light intensity for forming the latent image on the surface of the image carrier and developing potential for developing the latent image with toner is not suitable for an environmental condition, desired image density of the toner image (toner adhesion amount per unit area) cannot be obtained.

In the image forming apparatus disclosed in Japanese Patent Application Laid-open No. 2002-006568, toner images formed on surfaces of photosensitive elements are transferred onto a recording medium that is conveyed while being held on a surface of a transfer belt (a belt member), and the following operation is performed at a predetermined timing. After forming toner patch images for detecting the image density on the photosensitive elements, the toner patch images are transferred onto the surface of the transfer belt while the recording medium is not held. The image density of the toner patch images formed on the transfer belt is detected by an optical sensor such as a reflection-type photodetector, and the image forming conditions are adjusted based on a result of detecting the image density. With this configuration, even if the environmental condition is changed, the image density can be kept stable by adjusting the image forming conditions.

The image forming apparatus disclosed in Japanese Patent Application Laid-open No. 2002-006568 is a tandem-type full-color image forming apparatus. In the tandem-type image forming apparatus, a toner image is formed on each of a plurality of image carriers for different colors arranged along a surface of a belt member, and the toner images are transferred in a superposing manner onto the surface of the belt member or a recording medium held on the surface of the belt member. A full-color toner image can be formed by forming the toner images with different colors on the image carriers and superposing them on the surface of the belt member or the recording medium.

Another type of tandem-type full-color toner image forming apparatus is disclosed in Japanese Patent Application Laid-open No. 2001-034030. In this image forming apparatus, toner images with different colors are respectively formed on a plurality of photosensitive elements arranged along a surface of an intermediate transfer belt (a belt member), and the toner images are transferred in a superposing manner onto the surface of the intermediate transfer belt, thereby obtaining a full-color toner image. The image forming apparatus regularly detects a relative displacement of each toner image at a predetermined timing, and corrects a timing to start writing a latent image and the like based on a result of detecting the relative displacement. Specifically, a toner image for detecting the displacement is formed on each of the photosensitive elements, and the toner images formed on the photosensitive elements are sequentially transferred onto the intermediate transfer belt, thereby forming a pattern image for detecting the relative displacement on the intermediate transfer belt. The relative displacement of the toner images in the pattern image is obtained based on a difference in times at which the toner images are detected by the photosensors. Then, the timing to start writing a latent image on each photosensitive element is adjusted based on the detection result.

With this configuration, a color misalignment due to the relative displacement of each toner image can be reduced. In general, in the tandem-type image forming apparatus, if a lens, a mirror, or the like in an optical-scanning unit for forming a latent image thermally expands or contracts due to a temperature change, a relative displacement is caused at a position at which writing a latent image starts on each photosensitive element, which results in the color misalignment. The above-described image forming apparatus detects the relative displacement of each toner image based on the difference in times at which the toner images in the pattern image are detected by the photosensors, and adjusts the timing to start writing a latent image and the like based on the detection result, to avoid the color misalignment.

In the above technologies, the image forming apparatus detects the toner patch images on the belt member or the image density of the toner images based on the change in optical reflectance on the surface of the belt member. However, if a distance between the surface of the belt member and the optical sensors slightly varies due to a ripple in the movement of the belt member, accuracy in detecting the toner patch images and the image density is degraded. Therefore, it is desired that the photosensors detect the toner patch images and the image density at a belt supporting area in which the belt member is supported by a supporting roller because the belt member shows virtually no ripple in the belt supporting area. For example, in the image forming apparatus disclosed in Japanese Patent Application Laid-open No. 2002-006568, the belt supporting area is taken as a target detection area.

However, in many cases, an area for arranging the photosensors to detect the belt supporting area is used for other purposes, making it difficult to secure a space for the photosensors. If a supporting roller dedicated to suppressing a ripple of the belt member at a position opposite the photosensors is additionally provided, the perimeter of the belt member becomes long, so that the image forming apparatus becomes bulky.

The same problems may occur even when transmission-type photosensors are used instead of the reflection-type photosensors.

SUMMARY OF THE INVENTION

It is an object of the present invention to at least partially solve the problems in the conventional technology.

According to an aspect of the present invention, there is provided an image forming apparatus including an image carrier on which a toner image is formed; an endless belt member that is supported by a plurality of supporting rollers; a transfer unit that transfers the toner image formed on the image carrier onto a surface of the endless belt member; an optical sensor that detects at least one of the toner image and a toner adhesion amount per unit area in the toner image based on a change of an optical characteristic on the surface of the endless belt member; a control unit that performs a predetermined process based on a detection result obtained by the optical sensor; and a sensor moving unit that moves the optical sensor between a first position in opposite to a belt supporting area in which the endless belt member is supported by one of the supporting rollers and a second position that is different from the first position. Either one of a recording member on which the toner image is to be recorded and a predetermined member that is moved by a driving unit is temporarily entered into the first position. The detection result is obtained by the optical sensor when the optical sensor is placed at the first position by the sensor moving unit.

Furthermore, according to another aspect of the present invention, there is provided an image forming apparatus including an image carrier on which a toner image is formed; an endless belt member that is supported by a plurality of supporting rollers; a transfer unit that transfers the toner image formed on the image carrier onto a surface of the endless belt member; an optical sensor that detects at least one of the toner image and a toner adhesion amount per unit area in the toner image based on a change of an optical characteristic on the surface of the endless belt member; a control unit that performs a predetermined process based on a detection result obtained by the optical sensor; and a sensor moving unit that moves the optical sensor between a first position in opposite to a first belt area in a belt supporting area in which the endless belt member is supported by any one of the supporting rollers and a second position in opposite to a second belt area in the belt supporting area farther than the first belt area from a center of the belt supporting area in an endless belt moving direction. Either one of a recording member on which the toner image is to be recorded and a predetermined member that is moved by a driving unit is temporarily entered into the first position. The detection result is obtained by the optical sensor when the optical sensor is placed at the first position by the sensor moving unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

In an embodiment of the present invention, the present invention is applied to a tandem indirect-transfer-type color laser printer (hereinafter, simply "a printer") 1 that is an electrophotographic image forming apparatus.

Figure 1:
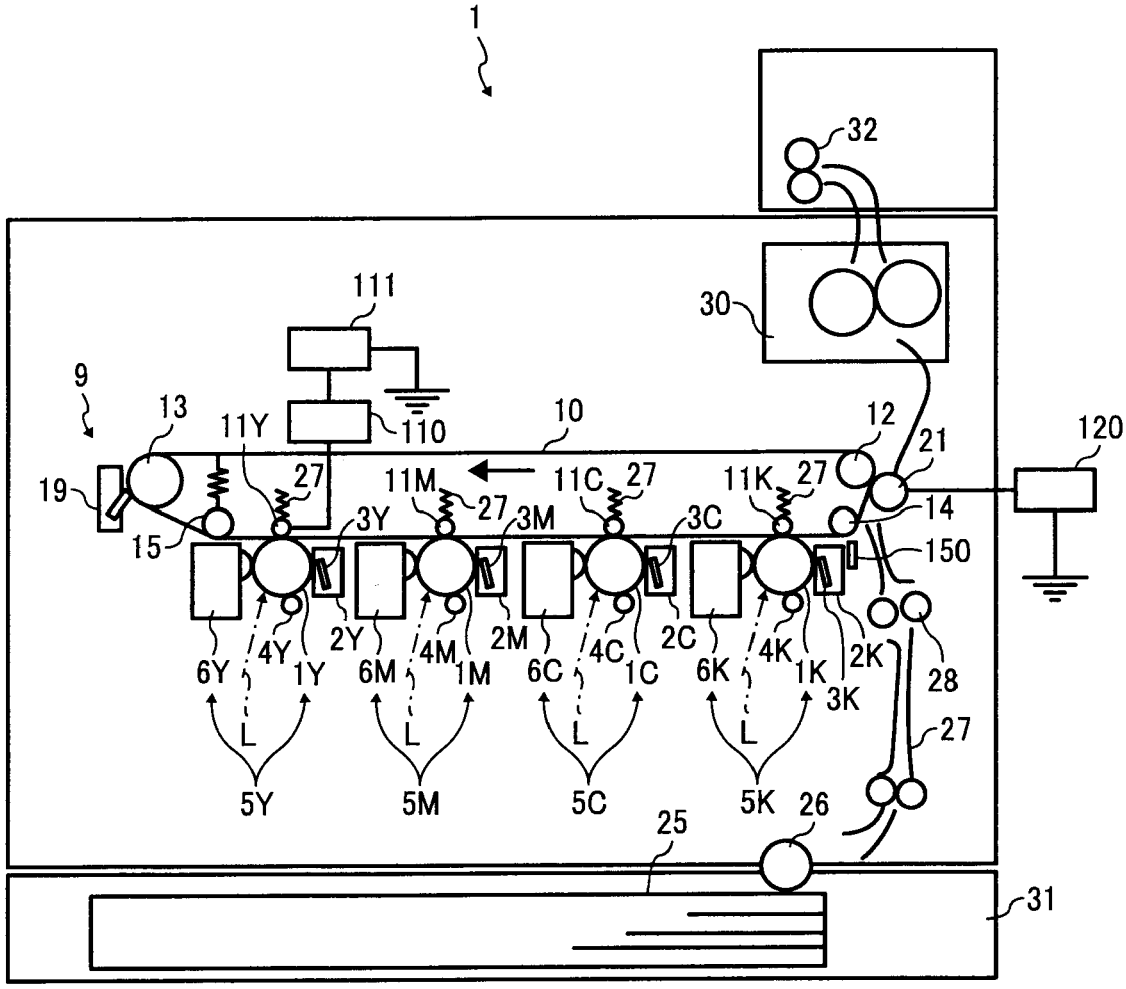
FIG. 1 is a schematic diagram of a printer according to an embodiment of the present invention.

FIG. 1 is a schematic diagram of the printer 1 according to the embodiment. An intermediate transfer belt 10 that is an endless-belt member is provided in the middle of the printer 1. The intermediate transfer belt 10 has a multi-layered structure in which a base layer (e.g., a sheet with low tensile) is made of a fluorine resin such as a polyvinylidene difluoride (PVDF) or a polyimide resin and the surface of the base layer is covered with a coat layer with excellent smoothness such as one made of a fluorine resin. As shown in FIG. 1, the intermediate transfer belt 10 is rotatable counterclockwise in a state of being supported by supporting rollers.

In the printer 1, supporting rollers including a driving roller 12, a cleaning backup roller 13, a secondary transfer-nip entrance roller 14, and a tension roller 15 are provided inside the loop of the intermediate transfer belt 10 to support the intermediate transfer belt 10. The driving roller 12 is driven to rotate counterclockwise in FIG. 1 by a driving unit (not shown), thereby moving the intermediate transfer belt 10 in a counterclockwise direction. The cleaning backup roller 13 nips the intermediate transfer belt 10 with a belt cleaning unit 19, thereby backing up cleaning by the belt cleaning unit 19. The secondary transfer-nip entrance roller 14 supports the intermediate transfer belt 10 at a position a little upstream of a secondary transfer nip in a belt moving direction in which the intermediate transfer belt 10 moves. The tension roller 15 is biased toward the intermediate transfer belt 10 by a bias coil spring, thereby applying tension to the intermediate transfer belt 10.

The printer 1 includes process units 5Y, 5M, 5C, and 5K as image forming units for forming toner images of four colors of yellow (Y), magenta (M), cyan (C), and black (B). The process units 5Y, 5M, 5C, and 5K have the same configuration except that they use toners with different colors of Y, M, C, and K as image forming substances. The process units 5Y, 5M, 5C, and 5K are each replaced when its lifetime ends. For example, the process unit 5Y for forming a Y-toner image includes a drum-shaped photosensitive element 1Y as an electrostatic latent image carrier, a cleaning unit 2Y, a neutralizing unit (not shown), a charging roller 4Y, and a developing unit 6Y, and is detachable from the of the printer body, so that parts in the process unit 5Y that worn out can be replaced at one time.

The charging roller 4Y that is applied with a charging bias by a power source (not shown) is arranged to be in contact with or to be close to the photosensitive element 1Y, and uniformly charges the surface of the photosensitive element 1Y in a polarity (negative in the present embodiment) same as the charging polarity of the Y-toner by generating a discharge between the surface of the charging roller 4Y and the surface of the photosensitive element 1Y. The uniformly charged surface of the photosensitive element 1Y is scanned by a laser beam L emitted from an optical-writing unit, so that a Y-latent image is carried on the surface. The developing unit 6Y that uses the Y-toner develops the Y-latent image, so that a Y-toner image is formed. The Y-toner image is transferred onto the intermediate transfer belt 10. The cleaning unit 2Y removes Y-toner remaining on the surface after the intermediate transfer process by a cleaning blade 3Y. The neutralizing unit removes residual charges on the photosensitive element 1Y after the cleaning, so that the surface of the photosensitive element 1Y is neutralized to be ready for the next image forming operation. The process units 5M, 5C, and 5K form toner images of M, C, and K on the photosensitive elements 1M, 1C, and 1K in the same manner. The toner images are superposed in order on the Y-toner image on the intermediate transfer belt 10.

In the present embodiment, the charging rollers 4Y, 4M, 4C, and 4K are provided as charging units to uniformly charge the photosensitive elements 1Y, 1M, 1C, and 1K. Alternatively, charging brush rollers, scorotron charging units, or corotron charging units can be provided.

The developing unit contains a one-component developer including only a toner or a two-component developer including a magnetic carrier and a toner. In the present embodiment, the developing units 6Y, 6M, 6C, and 6K can contain any of the developers.

The process units 5Y, 5M, 5C, and 5K are aligned along the lower-side surface of the intermediate transfer belt 10 that is supported to extend in a horizontal direction. The optical-writing unit (not shown) as a latent image writing unit is provided below the process units 5Y, 5M, 5C, and 5K. The optical-writing unit scans the photosensitive elements 1Y, 1M, 1C, and 1K with the laser beam L emitted based on image data transmitted from an external personal computer (PC), a scanner, or the like. Specifically, the optical-writing unit irradiates the photosensitive element with the laser beam L from the light source through an optical system including a plurality of optical lenses and mirrors with scanning the laser beam by the polygon mirror that is rotated by a motor.

A feeding cassette 25, a feeding roller 26, and the like are arranged in the lower part of a casing of the printer 1. A plurality of recording sheets P as sheet-like recording members is stacked in the feeding cassette 25, and the recording sheet P on the top is in contact with the feeding roller 26. Once the feeding roller 26 is driven to rotate counterclockwise in FIG. 1 by a driving unit (not shown), the recording sheet P on the top is fed toward a sheet conveying path 27.

A pair of registration rollers 28 as a feeding unit is arranged near the end of the sheet conveying path 27. The registration rollers 28 are driven to rotate to nip the recording sheet P, and temporarily stop its rotation just after nipping the recording sheet P. The registration rollers 28 restart its rotation at a predetermined timing to feed the recording sheet P toward a secondary transfer nip at an appropriate timing.

The intermediate transfer belt 10 arranged above the process units 5Y, 5M, 5C, and 5K in FIG. 1 constitutes a part of a transfer unit 9. The transfer unit 9 includes the belt cleaning unit 19 and a secondary transfer roller 21 that are arranged outside the loop of the intermediate transfer belt 10, and primary transfer-bias rollers 11Y, 11M, 11C, and 11K that are arranged in the loop of the intermediate transfer belt 10, in addition to the intermediate transfer belt 10 and the supporting rollers 12 to 15.

The primary transfer-bias rollers 11Y, 11M, 11C, and 11K nip the intermediate transfer belt 10 with the photosensitive elements 1Y, 1M, 1C, and 1K to form primary transfer nips. A primary transfer-bias power source 111 is connected to the primary transfer-bias rollers 11Y, 11M, 11C, and 11K through a switch 110. The primary transfer-bias power source 111 supplies a primary transfer bias having a polarity opposite to the toner charging polarity to each of the primary transfer-bias rollers 11Y, 11M, 11C, and 11K. A primary transfer electric field is formed in each primary transfer nip by applying the primary transfer bias to each of the primary transfer-bias rollers 11Y, 11M, 11C, and 11K. As the intermediate transfer belt 10 moves to pass the primary transfer nips for Y, M, C, and K in order, the toner images of Y, M, C, and K are superposed on the intermediate transfer belt 10, thereby forming four color toner images (a composite color image) in which images of the four colors are superposed on the intermediate transfer belt 10.

The driving roller 12 arranged in the loop of the intermediate transfer belt 10 nips the intermediate transfer belt 10 with the secondary transfer roller 21 arranged outside the loop of the intermediate transfer belt 10, thereby forming a secondary transfer nip in which the secondary transfer roller 21 is in contact with the front surface of the intermediate transfer belt 10. A secondary transfer-bias power source 120 applies a primary transfer bias having a polarity opposite to the toner charging polarity to the secondary transfer roller 21. The driving roller 12 is grounded. The composite color image formed on the intermediate transfer belt 10 is transferred onto the recording sheet P at the secondary transfer nip, thereby forming a full-color image on the recording sheet P.

Toner that was not transferred onto the recording sheet P when the recording sheet P passed through the secondary transfer nip still adheres to the intermediate transfer belt 10. The toner is removed from the surface of the intermediate transfer belt 10 by the belt cleaning unit 19. The recording sheet P onto which the full-color image has been transferred at once at the secondary transfer nip is fed into a fixing unit 30 arranged above the secondary transfer nip.

The fixing unit 30 includes a fixing roller having a heat source such as halogen lamp inside, and a pressure roller that rotates while being in contact with the fixing roller under a predetermined pressure. A fixing nip is formed by the fixing roller and the pressure roller. The recording sheet P fed into the fixing unit 30 is nipped at the fixing nip so that the non-fixed toner image carrying side is in close contact with the fixing roller. Then, the toner of the full-color image is fused by heat, so that the full-color image is fixed on the recording sheet P by pressure.

The recording sheet P with the full-color image fixed thereon in the fixing unit 30 is discharged outside the printer 1 by a pair of discharging rollers 32.

When image data is transmitted from the external PC or the like, the driving roller 12 is driven to rotate by a driving motor (not shown), so that other supporting rollers rotate and the intermediate transfer belt 10 moves. At the same time, the photosensitive elements 1Y, 1M, 1C, and 1K rotate, and the toner images of Y, M, C, and K are formed on the photosensitive elements 1Y, 1M, 1C, and 1K. Then, the toner images are superposed in order on the intermediate transfer belt 10 to form the composite color image on the intermediate transfer belt 10.

Meanwhile, when the image data is transmitted from the external PC or the like, the feeding roller 26 rotates to pick up the recording sheets P one by one from the feeding cassette 25. The recording sheet P picked up by the feeding roller 26 is conveyed to the sheet conveying path 27 by conveying rollers. When the recording sheet P comes into contact with the registration rollers 28, the recording sheet P is once stopped. Then, in synchronization with the timing of the movement of the composite color image on the intermediate transfer belt 10, the registration rollers 28 restarts its rotation to feed the recording sheet P into the secondary transfer nip. Then, the composite color image on the intermediate transfer belt 10 is transferred onto the recording sheet P at once to form the full-color image on the recording sheet P.

The recording sheet P is then conveyed by the secondary transfer roller 21 to the fixing unit 30, in which the full-color image is fixed on the recording sheet P by heat and pressure. Thereafter, the recording sheet P is discharged by the discharging rollers 32 to be stacked on a discharge tray. The belt cleaning unit 19 removes the residual toner on the intermediate transfer belt 10 after the image transfer operation, so that the intermediate transfer belt 10 is ready for the next image formation.

Figure 9:
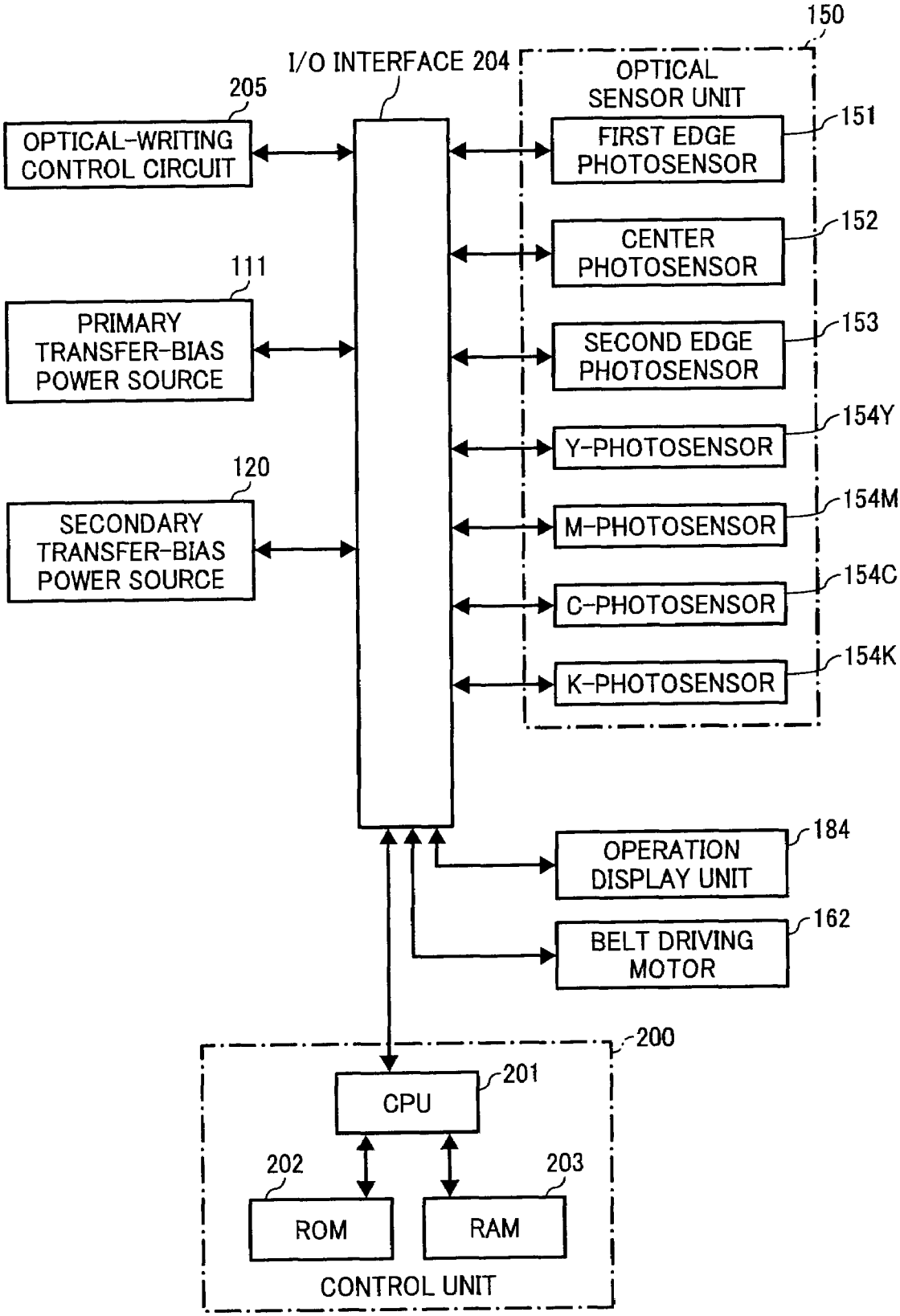
FIG. 9 is a block diagram of a part of an electric circuit of the printer according to the embodiment.

FIG. 9 is a block diagram of a part of an electric circuit in the printer 1. A control unit 200 includes a central processing unit (CPU) 201, a read only memory (ROM) 202 that stores control programs, various data, and the like, and a random access memory (RAM) 203 that temporarily stores various data. The primary transfer-bias power source 111, the secondary transfer-bias power source 120, an optical-writing control circuit 205 that controls the optical-writing unit, and the like are connected to the control unit 200 through an I/O interface 204 that is used for sending and receiving signals between peripheral control units. Moreover, a belt driving motor 162 that is a driving source of the driving roller 12, a operation display unit 184 including a touch panel, an optical sensor unit 150 including a first edge photosensor 151, a center photosensor 152, a second edge photosensor 153, a Y-photosensor 154Y, an M-photosensor 154M, a C-photosensor 154C, and a K-photosensor 154K are also connected to the control unit 200 through the I/O interface 204. The photosensors are each reflection-type photosensor that makes the light from a light emitting unit (not shown) reflect from a target surface to be detected and detects the reflected light by a light receiving unit.

The printer 1 performs an image-forming-condition adjusting process for adjusting the image forming condition for the image forming unit including the optical-writing unit and the process units 5Y, 5M, 5C, and 5K at a predetermined timing (e.g., every time a predetermined time elapses). In the image-forming-condition adjusting process, an image density adjusting process and a displacement correcting process are performed. The processes includes controlling the optical-writing unit by the optical-writing control circuit 205 based on instructions input from the control unit 200 through the I/O interface 204 and controlling driving of each of the process units and the transfer units by the control unit 200. With the processes, gradation pattern images for detecting image density and patch pattern images including toner images for detecting color misalignment are formed on the intermediate transfer belt 10.

Specifically, in the image density adjusting process, Y, M, C, and K gradation pattern images for detecting the image density are formed on the intermediate transfer belt 10. Each gradation pattern image includes 14 reference toner images each having a predetermined pixel pattern. Different amount of toner is adhered to each reference toner image, in other words, each reference toner image has a different image density.

Figure 10:
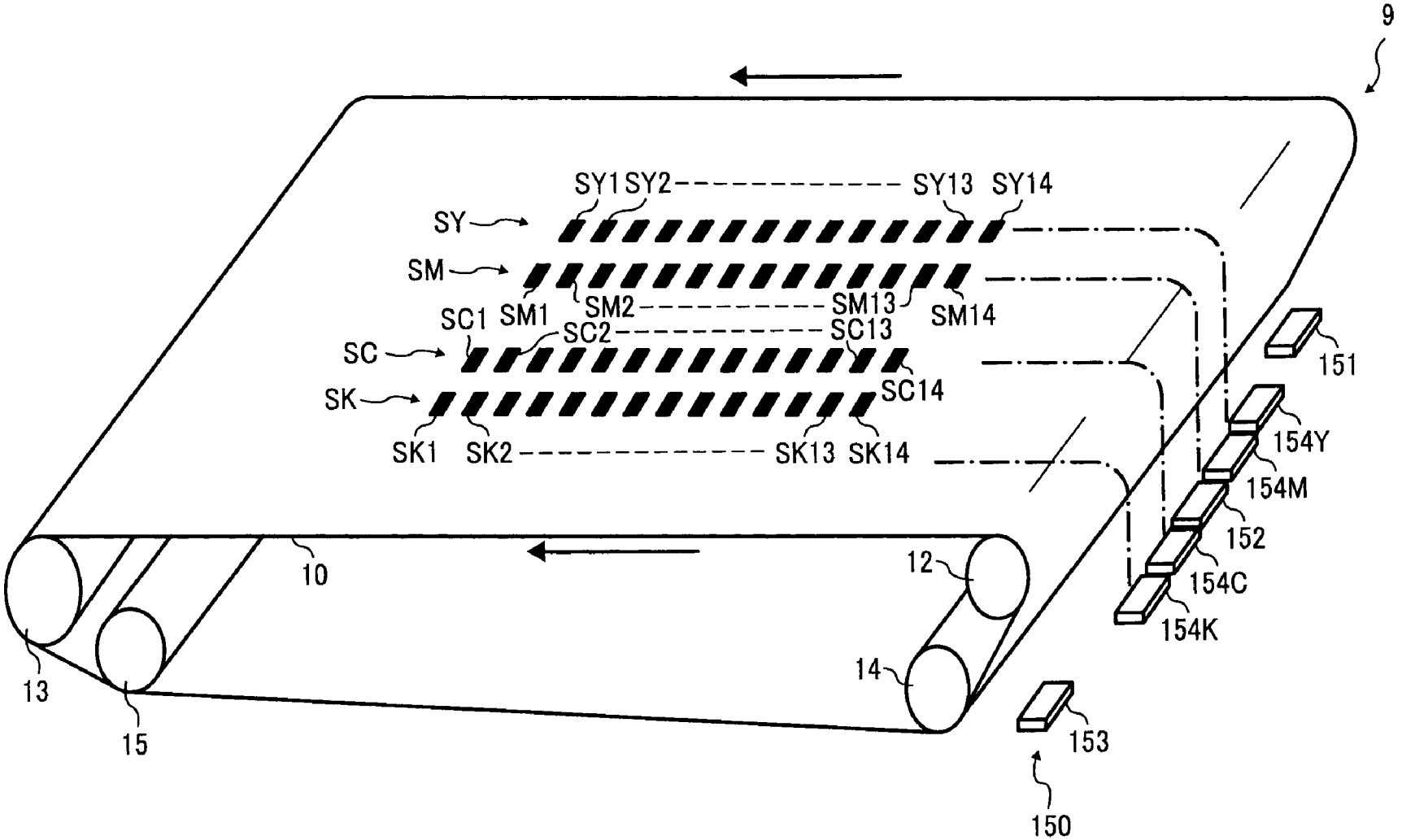
FIG. 10 is a perspective view representing gradation pattern images formed on an intermediate transfer belt of the printer according to the embodiment.

For example, a K-gradation pattern image SK shown in FIG. 10 includes 14 K-reference toner images (K-reference toner images $SK_1$, $SK_2$, . . . , $SK_{13}$, and $SK_{14}$) in which the amount of the toner adhered thereto is gradually increased in stages. The K-reference toner images are formed on the front surface of the intermediate transfer belt 10 with predetermined intervals therebetween in a belt moving direction in which the intermediate transfer belt 10 moves. The amount of the toner adhered per unit area in each K-reference toner image is detected by the K-photosensor 154K. A detection result of detecting the toner adhered per unit area is sent to the RAM 203 through the I/O interface 204 as output values $V_{pi}$ (i=1 to 14).

The photosensors 153, 154K, 154C, 152, 154M, 154Y, and 151 are aligned in this order in a belt width direction of the intermediate transfer belt 10 (a rotary axis direction of the supporting rollers). The K-photosensor 154K is arranged to be aligned with the K-reference toner images in the belt width direction to detect the K-reference toner images. In the same manner, the Y-photosensor 154Y, the M-photosensor 154M, and the C-photosensor 154C are aligned with Y-reference toner images, M-reference toner images, and C-reference toner images in the belt width direction to detect the Y-reference toner images, the M-reference toner images, and the C-reference toner images, respectively. The output values $V_{p1}$ to $V_{p14}$ from each of the Y, M, and C photosensors 154Y, 154M, and 154C, which are the detection result of detecting the toner amount adhered to each of the Y, M, and C reference toner images, are stored in the RAM 203.

The control unit 200 converts each output value into the toner amount per unit area adhered to each reference toner image based on the output values stored in the RAM 203 and a data table stored in the ROM 202, and stores them as a toner adhesion amount data in the RAM 203.

Figure 11:
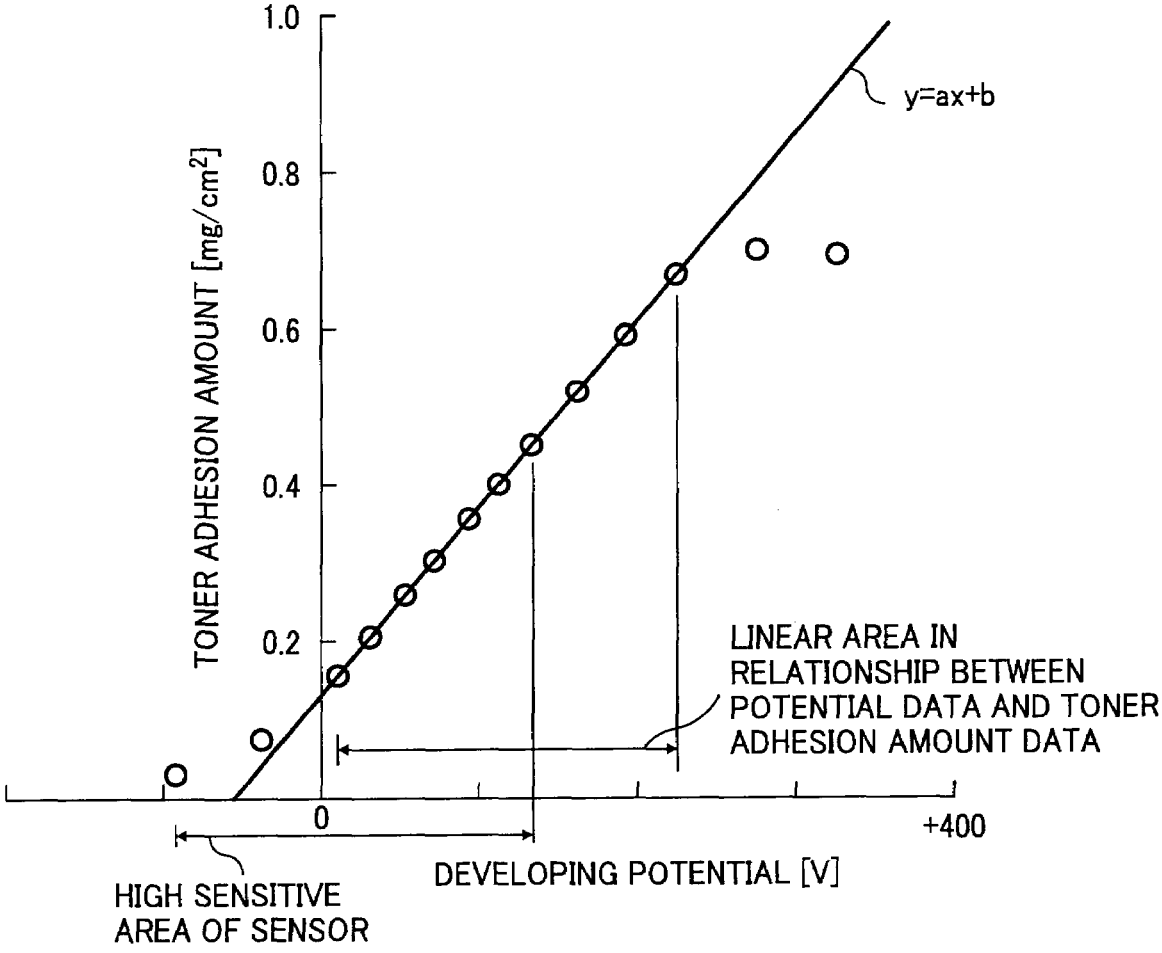
FIG. 11 is a graph representing a relation between a potential of a photosensitive element and a toner adhesion amount plotted on X-Y coordinates.

FIG. 11 is a graph representing a relation between a potential of the photosensitive element and the toner adhesion amount plotted on X-Y coordinates, in which an X-axis represents a developing potential (V) (a difference between a developing bias voltage at the time of forming the gradation pattern images and a surface potential of the photosensitive elements 1K, 1Y, 1M, and 1C), and a Y-axis represents a toner adhesion amount per unit area ($mg/cm^2$).

The control unit 200 selects the area in which a relationship between the potential data and the toner adhesion amount data (developing characteristics) shows a linear characteristic for each color based on the potential data and the toner adhesion amount data stored in the RAM 203, and performs smoothing on the data in the area. The developing characteristics of each developing unit are linearly approximated by using the least-squared method to the potential data and the toner adhesion amount data after the smoothing. Furthermore, after calculating an equation of a straight line (y=ax+b) for the developing characteristics of each developing unit, the image forming condition for each process unit is adjusted based on the gradient "a" of the equation of the straight line.

A method for adjusting the image forming condition includes one disclosed in Japanese Patent Application Laid-open No. H09-211911 in which a potential of a uniformly charged photosensitive element or a developing bias is adjusted. In the case of employing a two-component developing method, a control target value of a toner density of the two-component developer can be adjusted.

As shown in FIG. 10, in the image density adjusting process, the K-gradation pattern image SK including 14 K reference toner images $SK_1$, $SK_2$, . . . , $SK_{13}$, and $SK_{14}$ aligned at predetermined intervals in the belt moving direction (a sub-scanning direction) is formed. The C-gradation pattern image SC including 14 C-reference toner images $SC_1$, $SC_2$, . . . , $SC_{13}$, and $SC_{14}$ aligned at predetermined intervals in the sub-scanning direction is formed adjacent to the K-gradation pattern image SK in a main-scanning direction (the belt width direction). The M-gradation pattern image SM including 14 M-reference toner images $SM_1$, $SM_2$, . . . , $SM_{13}$, and $SM_{14}$ aligned at predetermined intervals in the sub-scanning direction is formed adjacent to the K-gradation pattern image SK in the main-scanning direction. The Y-gradation pattern image SY including 14 Y-reference toner images $SY_1$, $SY_2$, . . . , $SY_{13}$, and $SY_{14}$ aligned at predetermined intervals in the sub-scanning direction is formed adjacent to the M-gradation pattern image SM in the main-scanning direction.

Figure 12:
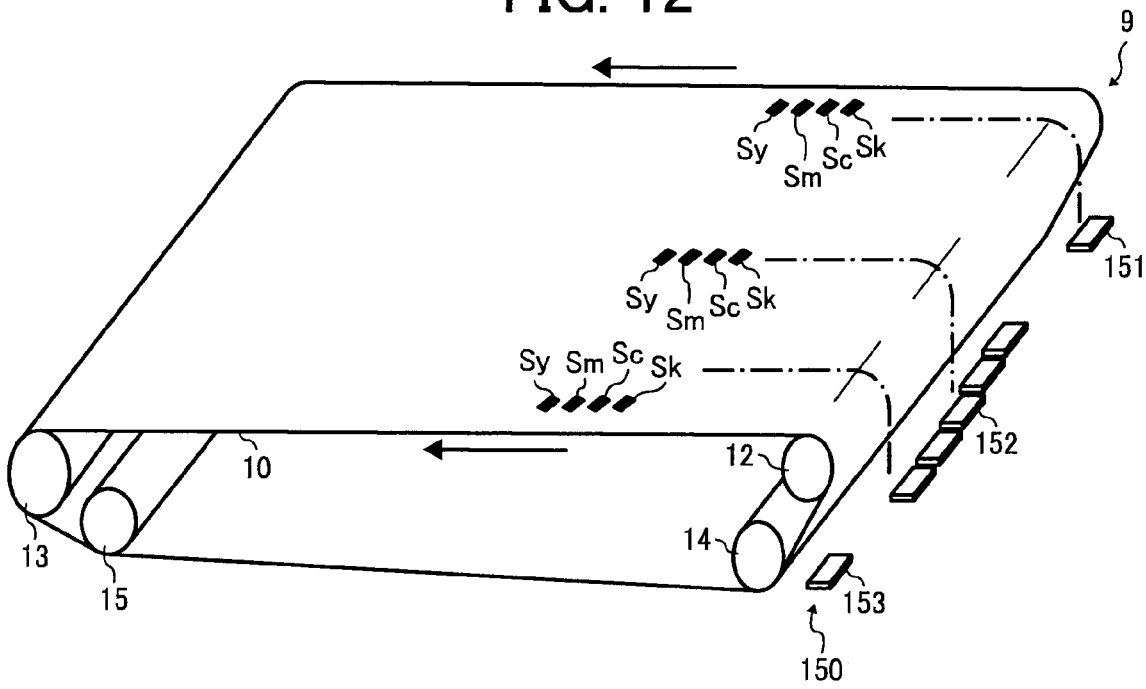
FIG. 12 is a perspective view representing patch pattern images formed on the intermediate transfer belt according to the embodiment.

In the displacement correcting process, the patch pattern images for detecting displacement are formed near both ends and center of the intermediate transfer belt 10 in the belt width direction as shown in FIG. 12. The patch pattern images each include Y, M, C, and K-reference toner images $S_y$, $S_m$, $S_c$, and $S_k$ aligned at predetermined intervals in the sub-scanning direction, and the reference toner images with the same color are aligned in the main-scanning direction.

In FIG. 12, the reference toner images in the patch pattern image formed near the edge of the far-side in the belt width direction are detected by the first edge photosensor 151, the reference toner images in the patch pattern image formed near the center in the belt width direction are detected by the center photosensor 152, and the reference toner images in the patch pattern image formed near the edge of the near-side in the belt width direction are detected by the second edge photosensor 153. If the reference toner images of each color are formed at an appropriate timing, the interval to detect the reference toner images of each color becomes equal. If the reference toner images of each color are not formed at an appropriate time, the interval to detect the reference toner images of each color becomes different. If a skew does not occur in the optical system for optical writing, the reference toner images of each color are detected at the same time between the patch pattern images; however, if a skew occurs in the optical system for optical writing, the reference toner images of each color are not detected at the same time between the patch pattern images. The control unit 200 adjusts the timing to start the optical writing on each photosensitive element or the optical system based on the difference of the interval or the time to detect each toner image in the main-scanning direction or the sub-scanning direction, thereby suppressing the displacement of each toner image.

When the gradation pattern images or the patch pattern images are formed, the secondary transfer roller 21 is separated from the intermediate transfer belt 10, so that the gradation pattern images or the patch pattern images are prevented from being transferred onto the secondary transfer roller 21.

A skew correction is performed by adjusting the gradient of a mirror for returning the laser beam of each color that is arranged in the optical-writing unit. A stepping motor is used as a driving source for tilting the mirror. A displacement correction of each toner image in the sub-scanning direction (the belt moving direction) is performed by adjusting the timing to start the optical writing on each photosensitive element. If a magnification of each reference toner image in the main-scanning direction in the Y, M, and C patch pattern images is different from that in the patch pattern for K that is the reference color, the magnification is corrected by a device such as a clock generator that is capable of changing the frequency of a signal in extremely small steps.

Figure 3:
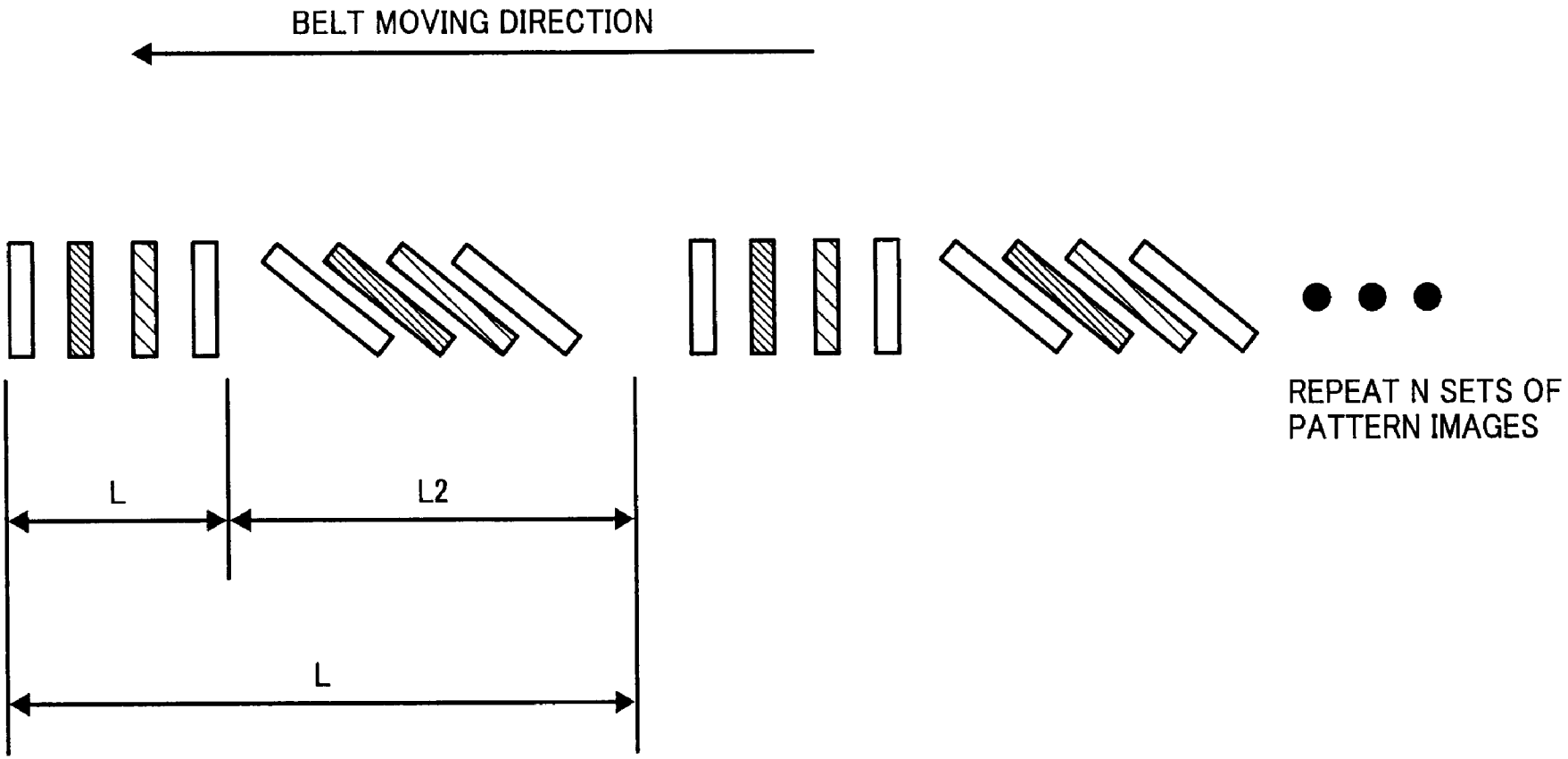
FIG. 3 is a schematic diagram representing a modification of gradation pattern images and patch pattern images.

As shown in FIG. 3, the gradation pattern images for detecting the image density and the patch pattern images for detecting the displacement can be formed alternately.

Figure 2:
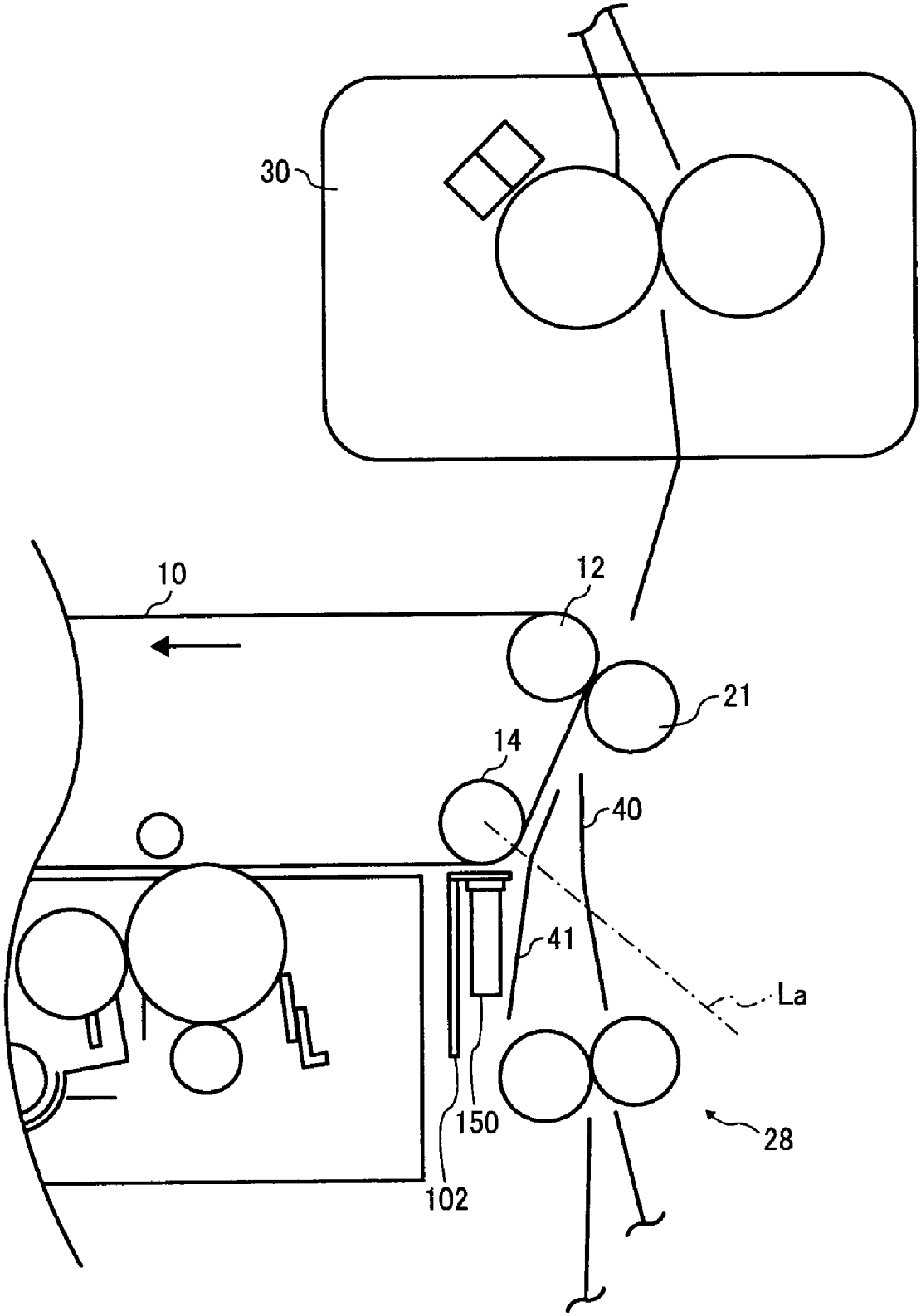
FIG. 2 is a schematic diagram of a portion around a secondary transfer nip in the printer.

FIG. 2 is a schematic diagram of a portion around the secondary transfer nip in the printer 1. As shown in FIG. 2, the optical sensor unit 150 is arranged below the secondary transfer-nip entrance roller 14. The reflection-type photosensor 153, 154K, 154C, 152, 154M, 154Y, and 151 of the optical sensor unit 150 are held by a bracket (not shown).

As shown in FIG. 1, the printer 1 includes the driving roller 12, the cleaning backup roller 13, the tension roller 15, and the secondary transfer-nip entrance roller 14 as the supporting rollers. The optical sensor unit 150 is preferably arranged on a side opposite any one of belt supporting areas in each of which a supporting roller supports the intermediate transfer belt 10.

In FIG. 2, the secondary transfer nip in which the driving roller 12 is positioned in the loop of the intermediate transfer belt 10 and the fixing unit 30 above the secondary transfer nip are separated by a relatively large distance for convenience sake; however, the distance is very slight in practice. The secondary transfer roller 21 is positioned on the right side of the driving roller 12 in FIG. 2. Therefore, the optical sensor unit 150 cannot be arranged opposite a belt supporting area by the driving roller 12.

A toner bottle (not shown) is arranged above the cleaning backup roller 13, and the belt cleaning unit 19 is arranged on the left side of the cleaning backup roller 13 in FIG. 2. Therefore, the optical sensor unit 150 cannot be arranged opposite a belt supporting area by the cleaning backup roller 13.

Because the tension roller 15 is supported in a movable manner and a bias coil spring can bias the tension roller 15, the tension roller 15 slightly moves with the movement of the intermediate transfer belt 10. Therefore, it is not preferable to arrange the optical sensor unit 150 opposite a belt supporting area by the tension roller 15. It is possible to make the tension roller 15 be a fixed supporting roller and make the cleaning backup roller 13 serve as the tension roller instead to be movable together with the belt cleaning unit 19. However, even with the configuration, because the developing unit 6Y is arranged opposite the belt supporting area by the tension roller 15, the optical sensor unit 150 cannot be arranged opposite the belt supporting area.

Although a feeding path is arranged opposite the secondary transfer-nip entrance roller 14, there is a small space in which the optical sensor unit 150 can be arranged on the side of the feeding path. Therefore, the optical sensor unit 150 is placed in the space. However, the optical sensor unit 150 arranged in the space opposes a belt area of the belt supporting area in which the intermediate transfer belt 10 starts to be wound around the secondary transfer-nip entrance roller 14, so that the intermediate transfer belt 10 in the belt area may show ripples. Therefore, the optical sensor unit 150 arranged in the space as shown in FIG. 2 cannot detect the gradation pattern images and the patch patter images with high accuracy. For detecting the gradation pattern images and the patch patter images with high accuracy, the optical sensor unit 150 needs to be arranged opposite a belt area of the belt supporting area by the secondary transfer-nip entrance roller 14 in which the intermediate transfer belt 10 does not show ripples, i.e., a belt area closer to a center La that is the center of the belt supporting area in the belt moving direction; however, a first conveying guide plate 41 is arranged in the belt area. That is, although the optical sensor unit 150 is desired to be arranged at a first position opposite the a first belt area that is close to the center La or includes the center La in the belt supporting area by the secondary transfer-nip entrance roller 14, the first conveying guide plate 41 is arranged at the first position. Therefore, the optical sensor unit 150 has to be arranged at a second position opposite a second belt area in the belt supporting area. The second belt area is distant from the center La, and the intermediate transfer belt 10 starts to be wound around the secondary transfer-nip entrance roller 14 at the second belt area.

A recording sheet is fed into the feeding path formed by the first conveying guide plate 41 and a second conveying guide plate 40 facing each other by the registration rollers 28; however, the recording sheet is not always fed into the feeding path. In other words, the recording sheet is fed into the feeding path only at a timing of moving the four color toner images on the intermediate transfer belt 10 to the secondary transfer nip for transferring the four color toner images onto the recording sheet. During the above timing, the gradation pattern images for detecting the image density or the patch pattern images for detecting the displacement are not formed. These pattern images are formed not for transferring them onto the recording sheet, but for detecting the image density and the displacement by the optical sensor unit 150. With the movement of the intermediate transfer belt 10 after the detection, these pattern images pass through the position opposite the secondary transfer roller 21 (at this time, the secondary transfer roller 21 is apart from the intermediate transfer belt 10), and are removed from the surface of the intermediate transfer belt 10 by the belt cleaning unit 19.

Figure 4:
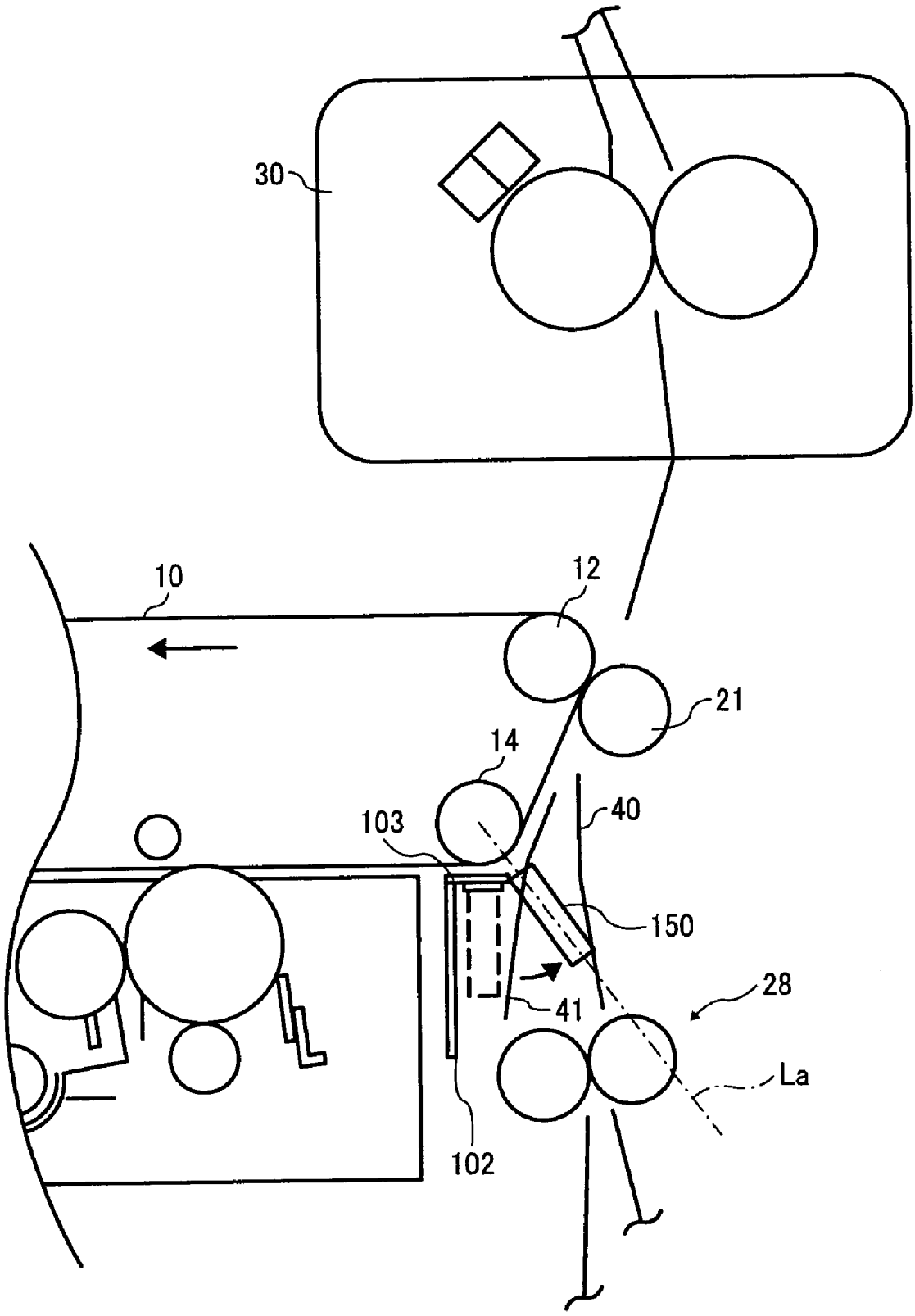
FIG. 4 is a schematic diagram for explaining a movement of an optical sensor unit of the printer from a second position to a first position.

Because the recording sheet is not fed into the feeding path when the gradation pattern images or the patch pattern images are formed, the feeding path does not need to function. Therefore, while detecting the pattern images, the optical sensor unit 150 can be placed at the first position on the feeding path. For moving the optical sensor unit 150 to the first position on the feeding path, a through hole of a size capable of making the optical sensor unit 150 pass therethrough is formed in the first conveying guide plate 41. A sensor moving unit (not shown) is provided for moving the optical sensor unit 150 from the second position as shown in FIG. 2 to the first position as shown in FIG. 4 for allowing the optical sensor unit 150 to detect the pattern images. When the optical sensor unit 150 is moved between the first position and the second position, the optical sensor unit 150 passes through the through hole formed in the first conveying guide plate 41. As is apparent from FIGS. 2 and 4, the first position is opposite the first belt area including the center La in the belt supporting area by the secondary transfer-nip entrance roller 14. In the present embodiment, the first position is just opposite the center La. The second position is opposite the second belt area that is farther from the center La than the first belt area.

The control unit 200 moves the optical sensor unit 150 from the second position to the first position only when allowing the optical sensor unit 150 to detect the pattern images on the intermediate transfer belt 10. With this configuration, the optical sensor unit 150 is retracted from the first position to the second position when a recording sheet as a predetermined member is entered into the first position, and can be moved to the first position from the second position only when the recording sheet does not need to be entered into the first position. Therefore, the optical sensor unit 150 can be positioned at the first position without providing an additional supporting roller. Thus, the gradation pattern images or the patch pattern images on the intermediate transfer belt 10 can be detected with high accuracy without making the printer 1 large in size.

Figure 13:
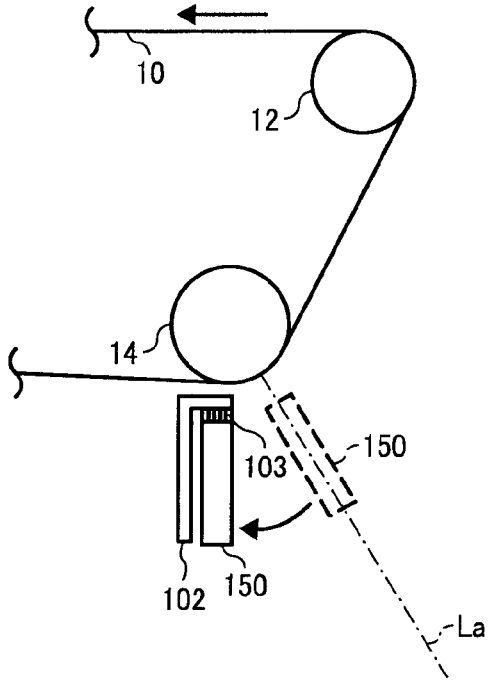
FIG. 13 is a schematic diagram of the optical sensor unit and its vicinity of the printer according to the embodiment.

FIG. 13 is a schematic diagram of the optical sensor unit 150 and its vicinity. As shown in FIG. 13, a protection member 102 is provided below the secondary transfer-nip entrance roller 14. When the optical sensor unit 150 is at the second position (indicated by a solid line in FIG. 13), the protection member 102 is located between detection surfaces (light emitting surfaces and light receiving surfaces) of the photosensors of the optical sensor unit 150 and the intermediate transfer belt 10 to protect the detection surfaces. With this configuration, toner falling toward the detection surfaces of the photosensors at the second position can be received by the protection member 102, so that the detection surfaces can be protected from getting dirty. In an image forming apparatus like the printer 1 in which the detection surfaces of the photosensors at the second position are positioned just under the front surface of the intermediate transfer belt 10, the detection surfaces can be protected from getting dirty by providing the protection member 102.

A cleaning brush 103 having a plurality of raisings as a cleaning member is fixed to the surface of the protection member 102 facing the photosensors. When the optical sensor unit 150 is moved from the first position indicated by a dotted line to the second position indicated by the solid line in FIG. 13, the cleaning brush 103 is in slide contact with the detection surfaces, thereby cleaning the detection surfaces. Therefore, even if toner adheres to the detection surfaces, the cleaning brush 103 can remove the toner.

In the printer 1, the secondary transfer-nip entrance roller 14 is arranged next to the driving roller 12 that supports the intermediate transfer belt 10 at the secondary transfer nip so that the secondary transfer-nip entrance roller 14 is upstream the driving roller 12 in the belt moving direction, and is utilized as a supporting roller that forms the belt supporting area at the position opposite the optical sensor unit 150. Because the feeding path formed by making the first conveying guide plate 41 and the second conveying guide plate 40 face each other is arranged on the upstream side of the secondary transfer nip in the belt moving direction, the secondary transfer-nip entrance roller 14 is normally arranged closest to the feeding path in the printer 1 among the supporting rollers. In the printer 1, the optical sensor unit 150 is opposite the belt supporting area by the secondary transfer-nip entrance roller 14, so that the space on the feeding path can be effectively utilized as the first position at which the optical sensor unit 150 can detect the pattern images with high accuracy.

A driving source of the sensor moving unit for moving the optical sensor unit 150 can be, for example, a solenoid or a motor.

Examples of the printer 1 are explained, in which more characteristic components are added. The components of a printer in each example are the same as the printer 1 if not specifically described.

In the printer in a first example, a sensor moving unit is configured such that the optical sensor unit 150 swings around the rotation center of the secondary transfer-nip entrance roller 14 that is a supporting roller forming a belt supporting area at the position opposite the optical sensor unit 150. With this configuration, a rotation shaft of the secondary transfer-nip entrance roller 14 can be utilized as a supporting member for movably supporting a bracket of the optical sensor unit 150, and the optical sensor unit 150 can be supported by the rotation shaft through its bearing. Therefore, the optical sensor unit 150 can be moved between the first position and the second position without additionally providing a supporting member for movably supporting the optical sensor unit 150.

Figure 5:
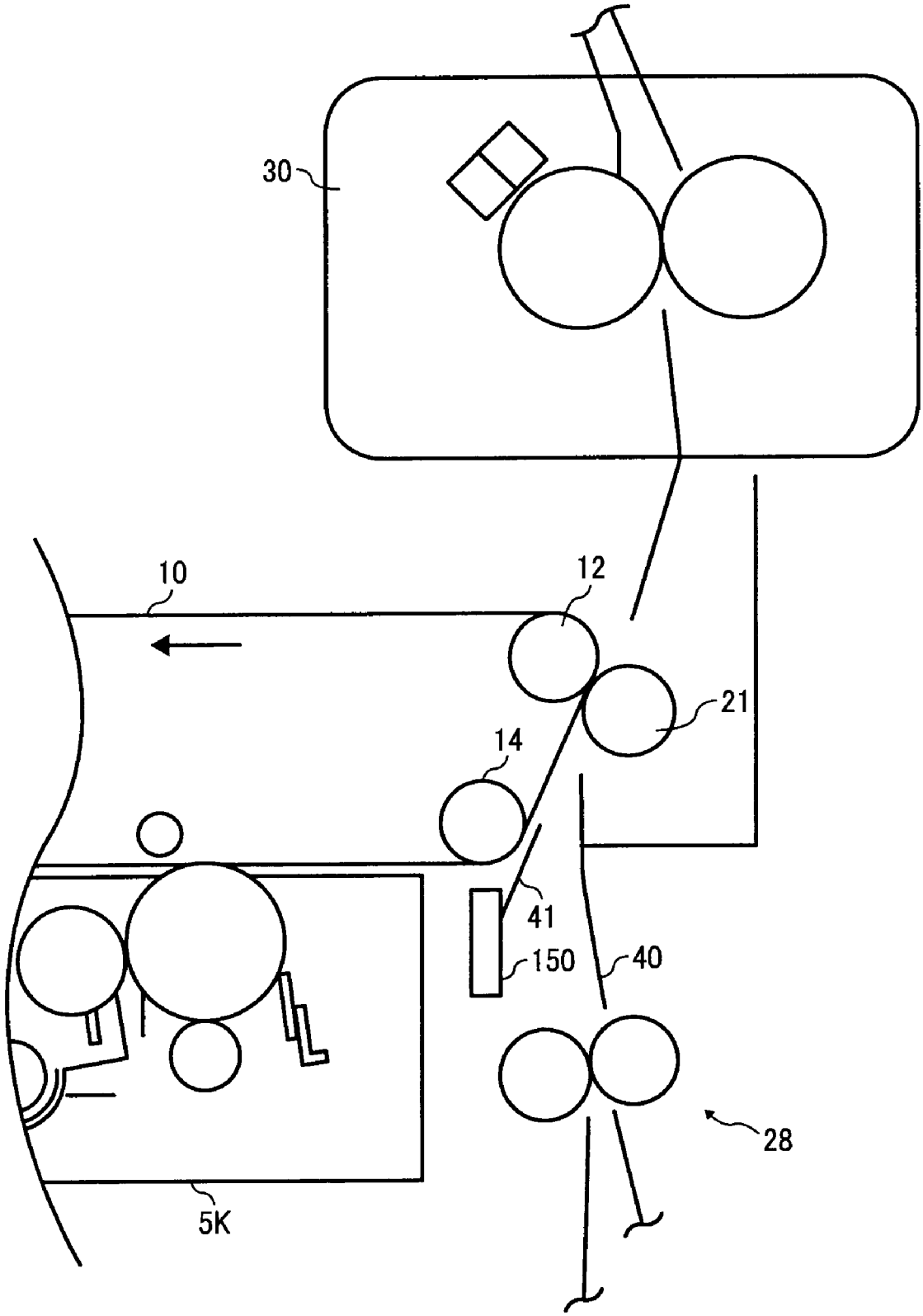
FIG. 5 is a schematic diagram of an optical sensor unit and its vicinity of a printer according to a second example of the present invention.
Figure 6:
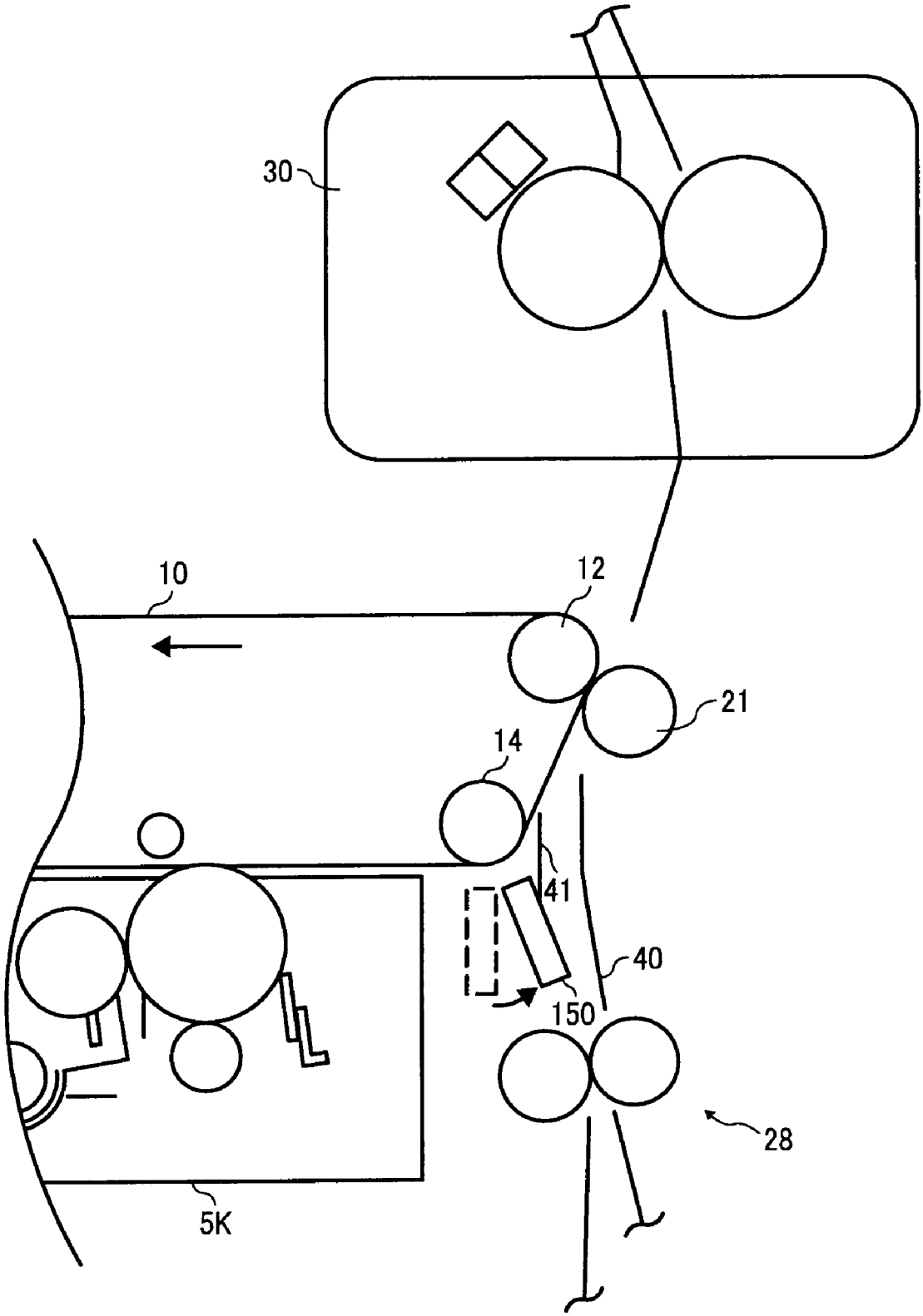
FIG. 6 is a schematic diagram for explaining a movement of the optical sensor unit from a second position to a first position.

FIG. 5 is a schematic diagram of the optical sensor unit 150 and its vicinity of a printer according to a second example. As shown in FIG. 5, the first conveying guide plate 41 does not have a though hole for allowing the optical sensor unit 150 to pass between the first position and the second position. Alternatively, the first conveying guide plate 41 is fixed to a bracket (not shown) of the optical sensor unit 150. As shown in FIG. 6, a sensor moving unit is configured such that the first conveying guide plate 41 moves together with the optical sensor unit 150.

As shown in FIGS. 10 and 12, the optical sensor unit 150 includes photosensors aligned along the belt width direction, and has a length approximately the same as the width of the intermediate transfer belt 10. In the case of forming a through hole in the first conveying guide plate 41 to make the optical sensor unit 150 pass therethrough as in the embodiment, the through hole needs to have a length approximately the same as the belt width, so that the size of the through hole becomes large. Hence, when the recording sheet is conveyed on the feeding path, the recording sheet may be jammed easily at the through hole. However, in the second example, the optical sensor unit 150 moves together with the first conveying guide plate 41, so that the through hole, which is large in size, does not need to be formed in the first conveying guide plate 41 for making the optical sensor unit 150 pass therethrough. Thus, the sheet jamming that may happen at the through hole in the first conveying guide plate 41 can be prevented.

Figure 7:
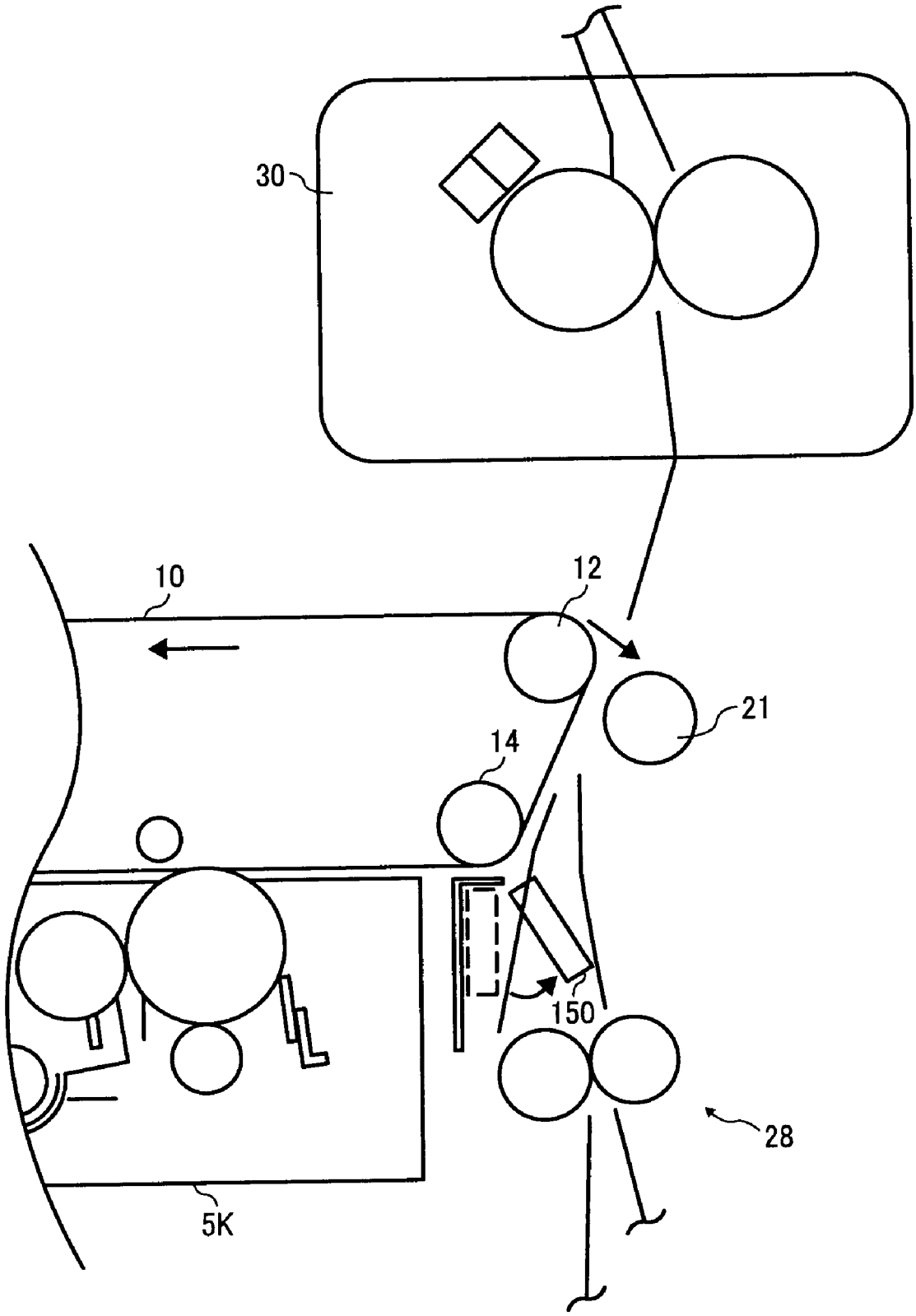
FIG. 7 is a schematic diagram for explaining a movement of an optical sensor unit of a printer from a second position to a first position according to a third example of the present invention.

FIG. 7 is a schematic diagram for explaining a movement of the optical sensor unit 150 of a printer from a second position to a first position according to a third example. In the third example, a sensor moving unit is configured such that the secondary transfer roller 21 that serves as a transfer-nip forming member is separated from an intermediate transfer belt 10 interlocking with the movement of the optical sensor unit 150 from the second position to the first position, and the secondary transfer roller 21 is brought into contact with the intermediate transfer belt 10 interlocking with the movement of the optical sensor unit 150 from the first position to the second position.

Figure 14:
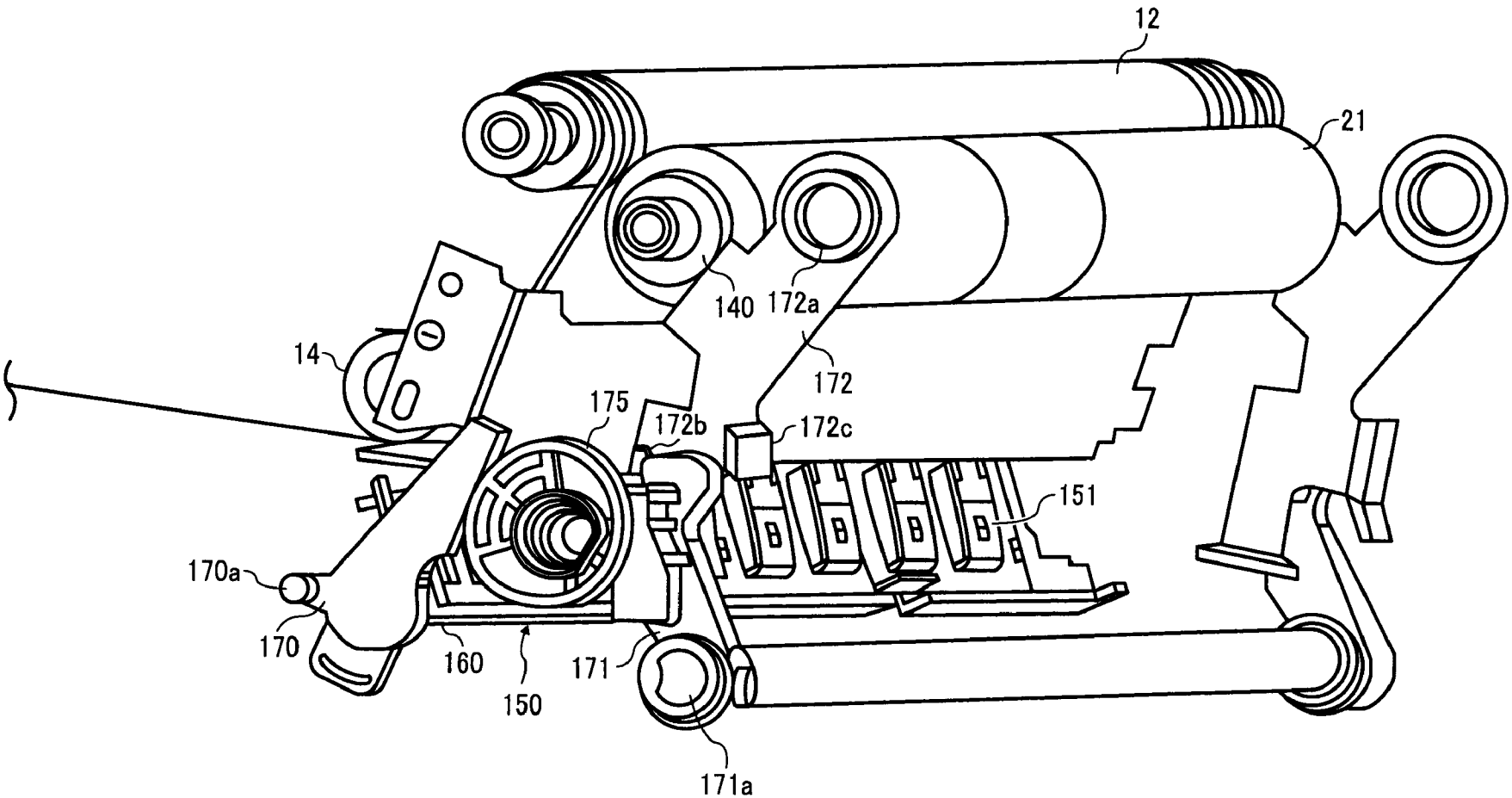
FIG. 14 is a perspective view of a link mechanism and a part of a transfer unit of a sensor moving unit in the printer according to a third example.

FIG. 14 is a perspective view of a link mechanism and a part of a transfer unit of the sensor moving unit. In FIG. 14, a rotation shaft of the secondary transfer roller 21 is supported by a bearing 140 in a rotatable manner. A separating coil spring (not shown) fixed to the bearing 140 applies a force to the secondary transfer roller 21 in a direction that separates the secondary transfer roller 21 from the intermediate transfer belt 10.

The link mechanism includes a sensor unit moving arm 170, a cam 175, a first roller moving arm 171, a second roller moving arm 172, and a cam driving motor (not shown). A bracket 160 of the optical sensor unit 150 including a plurality of photosensors is fixed to the sensor unit moving arm 170. The sensor unit moving arm 170 is supported by a bearing (not shown) of the printer body in a swingable manner around a swing shaft 170*a*. The sensor unit moving arm 170 swings around the swing shaft 170*a*, so that the optical sensor unit 150 fixed to the sensor unit moving arm 170 can move between the first position and the second position. A bias coil spring (not shown) is fixed to the sensor unit moving arm 170, so that a force is applied to the optical sensor unit 150 in a direction that moves the optical sensor unit 150 from the first position to the second position.

The first roller moving arm 171 is supported by the bearing of the printer body so that the first roller moving arm 171 swings around a swing shaft 171*a*. When the first roller moving arm 171 swings, the end of the first roller moving arm 171, which is an outer end on a swing trajectory of the first roller moving arm 171, comes into contact with a first protrusion 172*b* or a second protrusion 172*c* of the second roller moving arm 172 depending upon the position of the first roller moving arm 171 that is swinging.

The second roller moving arm 172 is supported by the bearing of the printer body to swing around the first protrusion 172*a*. The second roller moving arm 172 is in contact with the bearing 140 at its side end.

The cam 175 is arranged between the sensor unit moving arm 170 and the first roller moving arm 171 to be in contact with them. In FIG. 14, the cam 175 presses the sensor unit moving arm 170 in a direction against the biasing force of the bias coil spring, so that the optical sensor unit 150 moves to the first position at which the optical sensor unit 150 can detect the image density and the displacement with high accuracy. At the same time, the first roller moving arm 171 is in contact with a portion of the cam 175 with the shortest radius, so that the end of the first roller moving arm 171 is in contact with the second protrusion 172*c*. In this state, the second roller moving arm 172 is in contact with the bearing 140 of the secondary transfer roller 21, which is biased by the separation coil spring in the direction that separates the secondary transfer roller 21 from the intermediate transfer belt 10, at a position relatively distant from the intermediate transfer belt 10. Hence, the secondary transfer roller 21 is separated from the intermediate transfer belt 10. Briefly, in the state shown in FIG. 14, the link mechanism separates the secondary transfer roller 21 from the intermediate transfer belt 10 interlocking with the movement of the optical sensor unit 150 to the first position.

When the cam 175 rotates by the cam driving motor by a predetermined angle from the state shown in FIG. 14, the sensor unit moving arm 170 rotates by the predetermined angle clockwise around the swing shaft 170*a* by the biasing force by the bias coil spring. Then, the optical sensor unit 150 fixed to the sensor unit moving arm 170 is retracted from the first position to the second position. At the same time, the first roller moving arm 171 rotates by the predetermined angle clockwise in FIG. 14 around the swing shaft 171*a* to come into contact with the first protrusion 172*a* of the second roller moving arm 172 at its end. Then, the second roller moving arm 172 rotates by the predetermined angle clockwise in FIG. 14 around the first protrusion 172*a* to press the bearing 140 toward the intermediate transfer belt 10 against the biasing force by the separation coil spring, whereby the secondary transfer roller 21 comes into contact with the secondary transfer roller 21 to form the secondary transfer nip. Briefly, the link mechanism brings the secondary transfer roller 21 into contact with the intermediate transfer belt 10 interlocking with the retraction of the optical sensor unit 150 to the second position from the first position.

With this configuration, one driving source (the cam driving motor) controls an operation of separating the secondary transfer roller 21 from the intermediate transfer belt 10 and bringing the secondary transfer roller 21 into contact with the intermediate transfer belt 10 to prevent the gradation pattern images and the patch pattern images formed on the intermediate transfer belt 10 from transferring to the secondary transfer roller 21, and an operation of moving the optical sensor unit 150. Thus, the cost of the printer can be lowered and the control program can be simplified compared with the configuration in which a driving source is provided for each of the operations.

Specific examples of the printer in the third example are explained, in which more characteristic components are added. The configuration of the printer in each specific example is the same as the printer in the third example if not specifically described.

In the printer according to a first specific example of the third example, a registration roller driving motor (not shown) that is a driving source for rotating the registration rollers 28 also functions as a driving force for the optical sensor unit 150 and the secondary transfer roller 21. Specifically, a bracket of the optical sensor unit 150 is fixed to an arm (not shown) that is swingable around a swing shaft to which a gear (not shown) is fixed. The arm is biased by a bias coil spring (not shown), so that the optical sensor unit 150 is biased in a direction that moves the optical sensor unit 150 from the second position toward the first position. Therefore, under standard conditions, the optical sensor unit 150 is at the first position in which the optical sensor unit 150 can detect the gradation pattern images or the patch pattern images with high accuracy. Different from the printer in the third example, the home position of the optical sensor unit 150 in the first specific example is the first position. The gear fixed to the swing shaft of the arm meshes with a driving force transmitting system for receiving a driving force from a motor shaft of the registration roller driving motor. When the registration roller driving motor is driven to rotate, the arm swings around the swing shaft by the driving force so that the optical sensor unit 150 moves from the first position to the second position. When the optical sensor unit 150 reaches the second position, the gear fixed to the swing shaft of the arm starts to idle, so that the arm stops moving. Consequently, the optical sensor unit 150 is stopped at the second position.

When the registration roller driving roller starts to drive, the registration rollers 28 rotate and start to feed the recording sheet. The optical sensor unit 150 is retracted to the second position from the first position before the recording sheet reaches the first position on the feeding path. Therefore, the optical sensor unit 150 retracting from the first position to the second position is prevented from hitting the recording sheet being fed into the first position of the feeding path.

The bearing 140 of the secondary transfer roller 21 is fixed to an arm (not shown) that is swingable around a swing shaft to which a gear (not shown) is fixed. The arm is biased by a separating coil spring (not shown), so that the secondary transfer roller 21 is biased in a direction in which the secondary transfer roller 21 being in contact with the intermediate transfer belt 10 is separated from the intermediate transfer belt 10. Therefore, under standard conditions, the secondary transfer roller 21 is separated from the intermediate transfer belt 10. Different from the printer in the third example, when the secondary transfer roller 21 is at the home position, the secondary transfer roller 21 is separated from the intermediate transfer belt 10. The gear fixed to the swing shaft of the arm meshes with the driving force transmitting system for receiving the driving force from the motor shaft of the registration roller driving motor. When the registration roller driving motor is driven to rotate, the arm swings around the swing shaft by the driving force so that the secondary transfer roller 21 that is separated from the intermediate transfer belt 10 moves to come into contact with the intermediate transfer belt 10. When the secondary transfer roller 21 reaches the position so that the secondary transfer roller 21 forms a secondary transfer nip with the intermediate transfer belt 10, the gear fixed to the swing shaft of the arm starts to idle, so that the arm stops moving. Consequently, the secondary transfer roller 21 is stopped at the position at which the secondary transfer roller 21 is in contact with the intermediate transfer belt 10.

When the registration roller driving roller starts to drive, the registration rollers 28 rotate and start to feed the recording sheet. The secondary transfer roller 21 is moved to come into contact with the intermediate transfer belt 10 to form the secondary transfer nip before the recording sheet enters into a space between the intermediate transfer belt 10 and the secondary transfer roller 21.

When the registration roller driving roller is stopped, the arm supporting the bracket of the optical sensor unit 150 is moved around the swing shaft by the biasing force by the bias coil spring to move the optical sensor unit 150 from the second position to the first position. Moreover, the arm supporting the bearing 140 is moved around the swing shaft by the biasing force by the bias coil spring to move the secondary transfer roller 21 to be separated from the intermediate transfer belt 10.

With this configuration, the registration roller driving motor is used also as a driving source for the sensor moving unit that moves the optical sensor unit 150. Thus, the cost of the printer can be lowered and the control program can be simplified compared with the configuration in which a driving source is provided for each of the registration rollers 28 and the sensor moving unit. Moreover, the registration roller driving motor also functions as a driving source for moving the secondary transfer roller 21 to be separated from or in contact with the intermediate transfer belt 10, which results in further lowering the cost and simplifying the control program.

Figure 8:
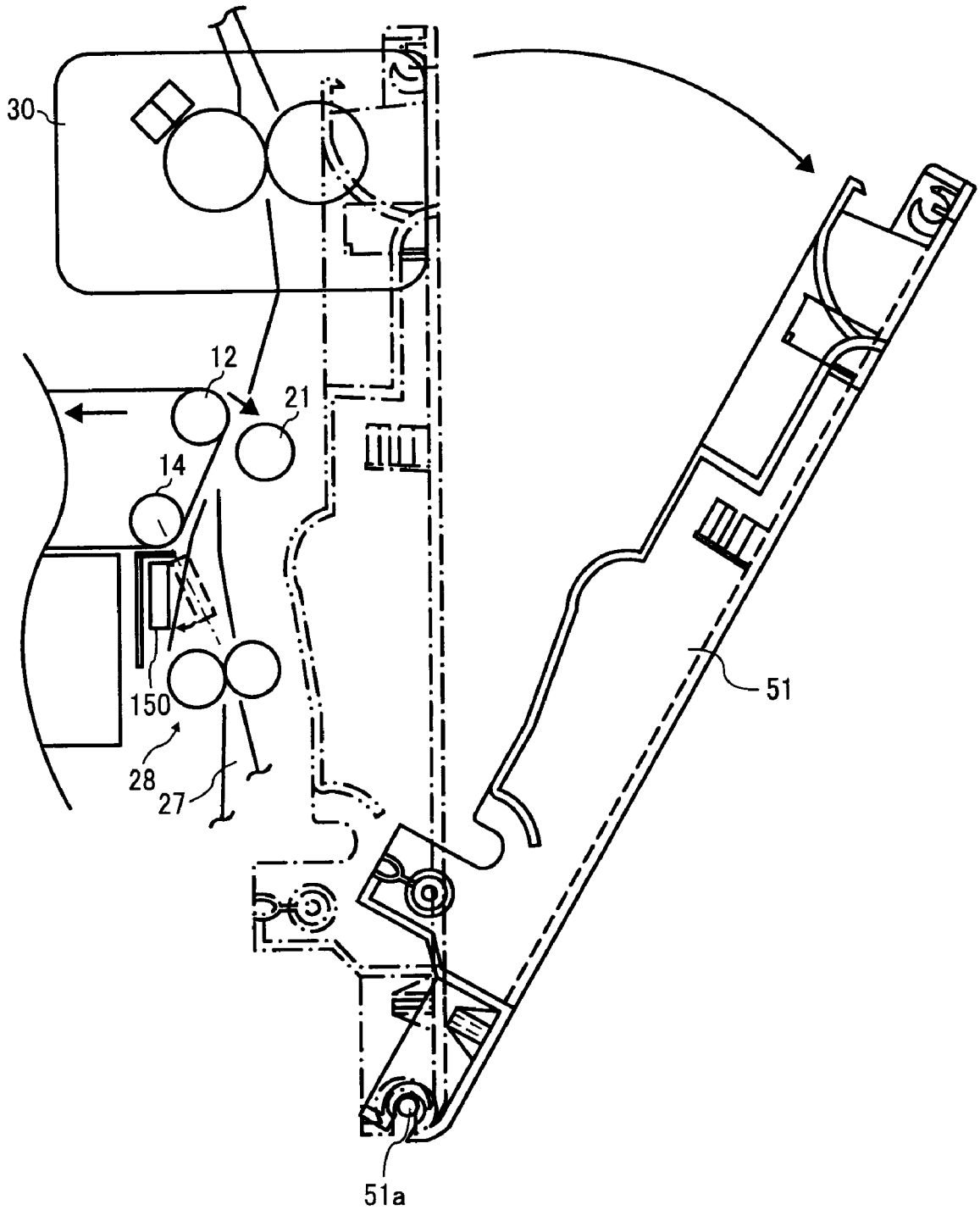
FIG. 8 is a schematic diagram of one end portion of a printer according to a second specific example of the third example.

FIG. 8 is a schematic diagram of one end portion of a printer according to a second specific example of the third example. As shown in FIG. 8, the printer includes an openable cover 51 as a door on one side of a casing of the printer. The cover 51 is swingable around a swing shaft 51*a* provided near the lower end of the printer body, so that the cover 51 can be opened and closed with respect to the casing. When the cover 51 is opened, the sheet conveying path 27, a feeding path, and the like are exposed outside, so that a recording sheet jammed in the paths can be removed easily. That is, the cover 51 is a door for exposing a recording sheet jammed in the secondary transfer nip, or before or after the secondary transfer nip, to the outside of the casing. If the secondary transfer roller 21 is separated from an intermediate transfer belt 10 in a state in which the cover 51 is opened, an operability of removing a jammed sheet can be improved.

Therefore, a sensor moving unit is configured such that when the cover 51 is opened, the optical sensor unit 150 is retracted to the second position, and the secondary transfer roller 21 is separated from the intermediate transfer belt 10. Specifically, when the recording sheet is fed into the registration rollers 28, the optical sensor unit 150 is at the second position that is distant from the feeding path, and the secondary transfer roller 21 is made in contact with the intermediate transfer belt 10 to form the secondary transfer nip. Most sheet jamming in the secondary transfer nip or before or after the secondary transfer nip occur when the optical sensor unit 150 and the secondary transfer roller 21 are in the above conditions. If the secondary transfer roller 21 is kept in contact with the intermediate transfer belt 10, the operability in removing a jammed sheet is not good. Therefore, when the cover 51 is opened, the secondary transfer roller 21 is made separated from the intermediate transfer belt 10 interlocking with the opening operation of the cover 51. At this time, the optical sensor unit 150 at the second position that is distant from the feeding path is kept unmoved.

When the optical sensor unit 150 is at the first position on the feeding path, and the secondary transfer roller 21 is in contact with the intermediate transfer belt 10, the sheet jamming rarely occurs. However, a front end of a recording sheet is occasionally jammed on the feeding path in a state in which the rear end of the recording sheet is nipped by the secondary transfer roller 21. Moreover, a user may open the cover 51 when the optical sensor unit 150 is at the first position and the secondary transfer roller 21 is in contact with the intermediate transfer belt 10 for a reason different from removing a jammed sheet. In this case, the sensor moving unit is configured such that when the cover 51 is opened, the secondary transfer roller 21 is separated from the intermediate transfer belt 10 and the optical sensor unit 150 is retracted to the second position from the first position. Therefore, it is prevented that a user touches the optical sensor unit 150 that is exposed to the outside at the first position.

The interlock of the opening operation of the cover 51 and the moving operation of the optical sensor unit 150 and the secondary transfer roller 21 can be realized mechanically or electronically. For example, the interlock of the opening operation of the cover 51 and the moving operation of the optical sensor unit 150 and the secondary transfer roller 21 can be controlled as follows. That is, in the printer of the third example, when the cam surface of the cam 175 is at a first rotation position, the optical sensor unit 150 is moved to the second position and the secondary transfer roller 21 is brought into contact with the intermediate transfer belt 10, and when the cam surface of the cam 175 is at a second rotation position, the optical sensor unit 150 is moved to the first position and the secondary transfer roller 21 is separated from the intermediate transfer belt 10. In addition, when the cam surface is at a third position, the optical sensor unit 150 is moved to the second position and the secondary transfer roller 21 is separated from the intermediate transfer belt 10. Moreover, a well-known detection sensor that detects the opening operation of the cover 51 is provided. When the detection sensor detects the opening operation of the cover 51, the cam 175 is rotated to the third rotation position.

It is explained that the printer has a configuration in which the first and the second belt areas are both in the belt supporting area, the first belt area is closer to the center La than the second belt area in the belt supporting area, the first position is opposite the first belt area, and the second position is opposite the second belt area. However, the printer can be configured such that the first position is opposite the belt supporting area and the second position is not opposite the belt supporting area.

It is explained that toner images based on a user command such as a print command are transferred onto the intermediate transfer belt 10 from the photosensitive elements. However, the printer can be configured such that the toner images are transferred directly onto a belt member from the photosensitive elements like the image forming apparatus disclosed in Japanese Patent Application Laid-open No. 2002-006568. Even with this configuration, the pattern images for detecting the displacement can be detected with the photosensors by transferring the pattern images not onto the recording sheet on the belt member but onto the surface of the belt member.

According to the embodiment, the sensor moving unit is such that when the recording sheet P is entered into the first position, the optical sensor unit 150 is retracted to the second position from the first position. Therefore, the jamming of the recording sheet P, which is caused by feeding the recording sheet P into the feeding path in a state where the optical sensor unit 150 is at the first position, is prevented. Moreover, the gradation pattern images and the patch pattern images can be detected with high accuracy.

Moreover, according to the embodiment, in the transfer unit 9, the toner images on the surface of the intermediate transfer belt 10 are transferred onto the recording sheet P at the secondary transfer nip that is the transfer position at which the recording sheet P is brought into close contact with the surface of the intermediate transfer belt 10, the registration rollers 28 that are the feeding unit to feed the recording sheet P toward the secondary transfer nip at the predetermined timing are arranged in the casing of the printer body, a predetermined member that enters into the first position at the predetermined timing is the recording sheet P that is fed toward the secondary transfer nip from the registration rollers 28, and the first position is on the feeding path that is for feeding the recording sheet P from the registration rollers 28 toward the secondary transfer nip. With this configuration, because the feeding path, into which the recording sheet is fed only at the predetermined timing, is utilized to place the optical sensor unit 150 at the first position at which the optical sensor unit 150 can detect the gradation pattern images and the patch pattern images with high accuracy, the printer is prevented from becoming large.

Furthermore, according to the embodiment, the secondary transfer-nip entrance roller 14, which is adjacent to and upstream of the driving roller 12 supporting the intermediate transfer belt 10 at the secondary transfer nip in the belt moving direction, is utilized as a supporting roller that forms the belt supporting area at the position opposite the optical sensor unit 150. With this configuration, by arranging the optical sensor unit 150 opposite the belt supporting area by the secondary transfer-nip entrance roller 14, the feeding path can be effectively utilized with ease to move the optical sensor unit 150 to the first position at which the patterns can be detected with high accuracy.

Moreover, according to the first example, the sensor moving unit is configured such that the optical sensor unit 150 swings around the rotation center of the secondary transfer-nip entrance roller 14 that forms the belt supporting area at the position opposite the optical sensor unit 150. With this configuration, the optical sensor unit 150 can be moved between the first position and the second position without providing additional supporting unit for movably supporting the optical sensor unit 150. In addition, because the distance between the belt surface and the sensor detection surface is made constant irrespective of the moving position of the optical sensor unit 150, a detection error can be prevented even if the stop position of the optical sensor unit 150 is slightly displaced.

Furthermore, according to the embodiment, the protection member 102 is provided between the optical sensor unit 150 and the intermediate transfer belt 10 to protect the optical sensor unit 150 at the second position. With this configuration, toner falling from the front surface of the intermediate transfer belt 10 toward the detection surface of each photosensor at the second position can be received by the protection member 102, so that the detection surfaces can be protected from getting dirty. Consequently, a decrease of the detection capability over time as the detection surfaces get dirty can be suppressed.

Moreover, according to the embodiment, the cleaning brush 103 as a cleaning member is fixed to the protection member 102 to clean the detection surfaces by sliding contact with the detection surfaces of the optical sensor unit 150 that is moved toward the second position from the first position. With this configuration, even if the detection surfaces get dirty due to the toner, the cleaning brush 103 can remove the dirt on the detection surfaces, so that a decrease of the detection accuracy as the detection surfaces get dirty can be prevented.

Furthermore, according to the second example, the sensor moving unit is configured such that the first conveying guide plate 41 that guides the recording sheet P on the feeding path toward the secondary transfer nip is moved together with the optical sensor unit 150. With this configuration, it is unnecessary to form the through hole, which is large in size, in the first conveying guide plate 41 for making the optical sensor unit 150 pass therethrough, thereby preventing jamming of the recording sheet in the through hole.

Moreover, according to the third example, the sensor moving unit is configured such that the secondary transfer roller 21 as the transfer-nip forming member is provided to form the secondary transfer nip by coming into contact with the intermediate transfer belt 10, the secondary transfer roller 21 is brought into contact with the intermediate transfer belt 10 interlocking with the movement of the optical sensor unit 150 from the first position to the second position, and the secondary transfer roller 21 is separated from the intermediate transfer belt 10 interlocking with the movement of the optical sensor unit 150 from the second position to the first position. With this configuration, one driving source (the cam driving motor) can control the operation of separating the secondary transfer roller 21 from the intermediate transfer belt 10 and bringing the secondary transfer roller 21 into contact with the intermediate transfer belt 10, and the operation of moving the optical sensor unit 150. Thus, the cost of the printer can be lowered and the control program can be simplified compared with the configuration in which a driving source is provided for each of the operations.

Furthermore, according to the first specific example, the sensor moving unit is configured such that the optical sensor unit 150 is moved by utilizing the driving force for the registration rollers 28. With this configuration, the registration roller driving motor is used also as a driving source for the sensor moving unit that moves the optical sensor unit 150. Thus, the cost of the printer can be lowered and the control program can be simplified compared with the configuration in which a driving source is provided for each of the registration rollers 28 and the sensor moving unit.

Moreover, according to the second specific example, the sensor moving unit is configured such that the cover 51 is provided to the casing as a door for exposing the recording sheet jammed in the secondary transfer nip, or before or after the secondary transfer nip to the outside of the casing, and the optical sensor unit 150 is retracted to the second position and the secondary transfer roller 21 is separated from the intermediate transfer belt 10 in a state in which the cover 51 is open. With this configuration, when the cover 51 is opened, the secondary transfer roller 21 is separated from the intermediate transfer belt 10, so that an operability of removing a jammed sheet can be improved. Moreover, when the cover 51 is opened, the optical sensor unit 150 is retracted to the second position, so that it is prevented that a user touches the optical sensor unit 150 that is placed at the first position and is exposed to the outside.

According to one aspect of the present invention, the toner images on the surface of the belt member and the image density thereof can be detected with high accuracy by placing the optical sensor at the first position opposite the belt supporting area by the supporting roller supporting the belt member compared with placing the optical sensor at the second position that is not opposite the belt supporting area. Because the recording member or the moving member such as the arm of the driving force transmitting system is temporarily enters into the first position, the optical sensor cannot be fixed at the first position. Therefore, the sensor moving unit is configured to move between the first position and the second position. When the optical sensor is at the first position at which the toner images or the image density thereof can be detected with high accuracy, the predetermined process such as a detection of the toner images for detecting the displacement and the image density of the toner images for detecting the image density is performed. Specifically, the optical sensor is retracted to the second position from the first position when the recording member or the moving member enters into the first position; however, the optical sensor is moved to the first position from the second position at the timing when the recording member or the moving member does not need to enter into the first position. Therefore, the optical sensor can be placed at the first position without providing an additional supporting roller, resulting in detecting the toner images and the image density thereof with high accuracy without making the apparatus large.

Moreover, according to another aspect of the present invention, at least the first belt area out of the first and second belt areas of the belt member is in the belt supporting area. Because the first belt area is closer to the center of the belt supporting area than the second belt area in the belt moving direction, a ripple of the belt member with the movement of the belt member can be suppressed in the first belt area. Therefore, the toner images and the image density thereof can be detected with high accuracy by the optical sensor placed at the first position compared with the case of placing the optical sensor at the second position. However, because the recording member or the moving member such as the arm of the driving force transmitting system is temporarily entered into the first position, the optical sensor cannot be fixed at the first position. Therefore, the optical sensor is allowed to move between the first position and the second position by the sensor moving unit. Thus, the toner images and the image density thereof can be detected with high accuracy without making the apparatus large.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier on which a toner image is formed;

an endless belt member that is supported by a plurality of supporting rollers, such that a belt supporting area is an area that is supported by one of the plurality of supporting rollers;

a transfer unit that transfers the toner image formed on the image carrier onto a surface of the endless belt member;

an optical sensor that detects at least one of the toner image and a toner adhesion amount per unit area in the toner image based on a change of an optical characteristic on the surface of the endless belt member;

a control unit that performs a predetermined process based on a detection result obtained by the optical sensor; and a sensor moving unit that moves the optical sensor between a first position and a second position that is different from the first position, wherein when the optical sensor is disposed in the second position, one of a recording member on which the toner image is to be recorded and a predetermined member that is moved by a driving unit is temporarily disposed in the first position and occupies a same location as occupied by the optical sensor when the optical sensor is in the first position, the optical sensor is configured to obtain the detection result when the optical sensor is disposed in the first position by the sensor moving unit, and the first position is disposed opposite of the belt supporting area.

2. The image forming apparatus according to claim 1, wherein the sensor moving unit is configured to retract the optical sensor from the first position to the second position when the predetermined member enters the first position.

3. The image forming apparatus according to claim 2, further comprising a feeding unit that feeds the recording member to a transfer position at which the recording member is brought into close contact with the surface of the endless belt member at a predetermined timing, wherein the transfer unit transfers the toner image on the endless belt member to the recording member at the transfer position, the predetermined member is the recording member that is fed by the feeding unit to the transfer position at the predetermined timing, and the first position is a position on a feeding path for feeding the recording member from the feeding unit to the transfer position.

4. The image forming apparatus according to claim 3, wherein the one of the supporting rollers that forms the belt supporting area is a first supporting roller that is adjacent to a second supporting roller that supports the endless belt member at the transfer position on an upstream side in a moving direction of the endless belt member.

5. The image forming apparatus according to claim 1, wherein the optical sensor is configured to swing around a rotation center of the one of the supporting rollers that forms the belt supporting area.

6. The image forming apparatus according to claim 1, further comprising a protection member that is provided between the optical sensor and the endless belt member at the second position, the protection member being configured to protect the optical sensor.

7. The image forming apparatus according to claim 6, further comprising a cleaning member that is fixed to the protection member, the cleaning member being configured to clean the optical sensor via contact with the optical sensor when the optical sensor is moved from the first position to the second position.

8. The image forming apparatus according to claim 3, further comprising a conveying guide plate that guides the recording member on the feeding path to the transfer position, wherein the conveying guide plate is configured to move together with the optical sensor.

9. The image forming apparatus according to claim 3, further comprising a transfer-nip forming member that forms a transfer nip at the transfer position by contacting the endless belt member, wherein the transfer-nip forming member is configured to contact the endless belt member in conjunction with a movement of the optical sensor from the first position to the second position, and the transfer-nip forming member is configured to separate from the endless belt member in conjunction with a movement of the optical sensor from the second position to the first position.

10. The image forming apparatus according to claim 3, wherein the optical sensor is configured to move by a driving force of the feeding unit.

11. The image forming apparatus according to claim 9, wherein a cover is provided on the casing and configured to expose a jammed recording member in the transfer nip or in front or behind the transfer nip to an outside of the casing, wherein the sensor moving unit is configured to retract to the second position and the transfer nip member is configured to separate from the endless belt member, when the cover is in an open position.

12. The image forming apparatus according to claim 10, wherein a cover is provided on the casing and configured to expose a jammed recording member in the transfer nip or in front or behind the transfer nip to an outside of the casing, wherein the sensor moving unit is configured to retract to the second position and the transfer nip member is configured to separate from the endless belt member, when the cover is in an open position.

13. An image forming apparatus comprising:

an image carrier on which a toner image is formed;

an endless belt member that is supported by a plurality of supporting rollers;

a transfer unit that transfers the toner image formed on the image carrier onto a surface of the endless belt member, such that a belt supporting area is an area that is supported by one of a plurality of supporting rollers;

an optical sensor that detects at least one of the toner image and a toner adhesion amount per unit area in the toner image based on a change of an optical characteristic on the surface of the endless belt member;

a control unit that performs a predetermined process based on a detection result obtained by the optical sensor; and a sensor moving unit that moves the optical sensor between a first position and a second position, wherein when the optical sensor is disposed in the second position, one of a recording member on which the toner image is to be recorded and a predetermined member that is moved by a driving unit is temporarily disposed in the first position and occupies a same location as occupied by the optical sensor when the optical sensor is in the first position, the optical sensor is configured to obtain the detection result when the optical sensor is disposed in the first position by the sensor moving unit, the first position is disposed opposite of a first belt area of the belt supporting area and the second position is disposed opposite of a second belt area of the belt supporting area, and the second belt area is farther from a center of the belt supporting area, in an endless belt moving direction, than the first belt area.

14. The image forming apparatus according to claim 13, wherein the sensor moving unit configured to retract the optical sensor from the first position to the second position when the predetermined member enters the first position.

15. The image forming apparatus according to claim 14, further comprising a feeding unit that feeds the recording member to a transfer position at which the recording member is brought into close contact with the surface of the endless belt member at a predetermined timing, wherein the transfer unit transfers the toner image on the endless belt member to the recording member at the transfer position, the predetermined member is the recording member that is fed by the feeding unit to the transfer position at the predetermined timing, and the first position is a position on a feeding path for feeding the recording member from the feeding unit to the transfer position.

16. The image forming apparatus according to claim 15, wherein the one of the supporting rollers that forms the belt supporting area is a first supporting roller that is adjacent to a second supporting roller that supports the endless belt member at the transfer position on an upstream side in a moving direction of the endless belt member.

17. The image forming apparatus according to claim 13, wherein the optical sensor is configured to swing around a rotation center of the one of the supporting rollers that forms the belt supporting area.

18. The image forming apparatus according to claim 13, further comprising a protection member that is provided between the optical sensor and the endless belt member at the second position, the protection member being configured to protect the optical sensor.

19. The image forming apparatus according to claim 18, further comprising a cleaning member that is fixed to the protection member, the cleaning member being configured to clean the optical sensor via contact with the optical sensor when the optical sensor is moved from the first position to the second position.

20. The image forming apparatus according to claim 15, further comprising a conveying guide plate that guides the recording member on the feeding path to the transfer position, wherein the conveying guide plate is configured to move together with the optical sensor.

* * * * *